US006062819A

United States Patent [19]

Zangeneh et al.

[11] Patent Number: 6,062,819

[45] Date of Patent: May 16, 2000

[54] TURBOMACHINERY AND METHOD OF MANUFACTURING THE SAME

[75] Inventors: Mehrdad Zangeneh, London, United Kingdom; Hideomi Harada; Akira Goto, both of Fujisawa, Japan

[73] Assignees: Ebara Corporation, Tokyo; Ebara Research Co., Ltd., Fujisawa, both of Japan; University College London, London, United Kingdom

[21] Appl. No.: 08/945,368

[22] PCT Filed: Dec. 7, 1995

[86] PCT No.: PCT/GB95/02904

§ 371 Date: Oct. 23, 1997

§ 102(e) Date: Oct. 23, 1997

[87] PCT Pub. No.: WO97/21035

PCT Pub. Date: Jun. 21, 1997

[51] Int. Cl.[7] ..... F04D 29/28

[52] U.S. Cl. ..... 416/186 R; 416/223 B; 416/188; 415/181

[58] Field of Search ..... 416/186 R, 185, 416/223 B, 223 A, 188; 415/181

[56] References Cited

U.S. PATENT DOCUMENTS

| | | | |
|---|---|---|---|
| 3,028,140 | 4/1962 | Lage | 416/188 |
| 4,465,433 | 8/1984 | Bischoff | 416/223 A |
| 5,112,195 | 5/1992 | Cox | 416/223 B |
| 5,458,457 | 10/1995 | Goto et al. . | |
| 5,685,696 | 11/1997 | Zangeneh et al. | 416/223 B |

OTHER PUBLICATIONS

L.H. Smith and H. Yeh, "Sweep and Dihedral Effects in Axial–Flow Turbomachinery", Transaction of the ASME, Journal of Basic Engineering, vol. 85, No. 3, Sep. 1963.

W. Zhongi, et al., "An Experimental Investigation into the Reasons of Reducing Secondary Flow Losses by Using Leaned Blades in Rectangular Turbine Cascades with Incidence Angle", ASME Paper 88–GT–4, Jun. 1988.

T.E. Biesinger and D.G. Gregory–Smith, "Reduction in Secondary Flows and Losses in a Turbine Cascade by Upstream Boundary Layer Blowing", ASME Paper 93–GT–114, May 1993.

Zangeneh, M., "A Compressible Three–Dimensional Design Method for Radial and Mixed Flow Turbomachinery Blades", International Journal of Numerical Methods of Fluids, vol. 13, 1991.

Borges, J.E., "A Three–Dimensional Inverse Method for Turbomachinery: Part I–Theory" Transaction of the ASME, Journal of Turbomachinery, vol. 112, Jul. 1990.

Yang, Y.L., Tan, C.S. and Hawthorne, W.R., "Aerodynamic Design of Turbomachinery Blading in Three–Dimensional Flow: An Application to Radial Inflow Turbines", ASME Paper 92–GT–74, Jun. 1992.

Dang, T.Q., "A Fully Three–Dimensional Inverse Method for Turbomachinery Blading in Transonic Flows", Transaction of the ASME, Journal of Turbomachinery, vol. 115, Apr. 1993.

Dawes, W.N., "Development of a 3D Navier Stokes Solver for Application to all Types of Turbomachinery", ASME Paper 88–GT–70, Jun. 1988.

Stepanoff, A.J., "Centrifugal and Axial Flow Pumps", John Wiley & Sons, New York, 1957.

Dicmas, J.L., "Vertical Turbine, Mixed Flow and Propeller Pumps", MacGraw–Hill, New York, 1962.

Borges, J.E., "A Proposed Through–Flow Inverse Method for the Design of Mixed–Flow Pumps", International Journal of Numerical Methods in Fluids, vol. 17, 1993.

(List continued on next page.)

*Primary Examiner*—Edward K. Look
*Assistant Examiner*—Richard Woo
*Attorney, Agent, or Firm*—Wenderoth, Lind & Ponack, L.L.P.

[57] ABSTRACT

An impeller in a turbomachinery has blades designed such that reduced static pressure difference ΔCp between the hub and the shroud on the suction surface of the blade shows a remarkably decreasing tendency near the impeller exit as it approaches the impeller exit between the impeller inlet and the impeller exit.

12 Claims, 25 Drawing Sheets

OTHER PUBLICATIONS

Zangeneh, M. and Hawthorne, W.R., "A Fully Compressible Three Dimensional Inverse Design Method Applicable to Radial and Mixed Flow Turbomachines", ASME Paper 90–GT–198, Jun. 1990.

Zangeneh, M., "Three Dimensional Design of a High Speed Radial Inflow Turbine by a Novel Design Method", ASME Paper 90–GT–235, Jun. 1990.

Zangeneh, M., "Inviscid–Viscous Interaction Method for 3D Inverse Design of Centrifugal Impellers", ASME Paper 93–GT–103, May 1993.

Goto, A., Zangeneh, M. and Takemura, T., "International Flow Fields in a Mixed–Flow Impeller Designed by Three–Dimensional Inverse Method", The Lecture of the 30th General Meeting in the Association of Turbomachinery, May 1994.

Zangeneh, M., Goto, A. and Takemura, T., "Suppression of Secondary Flows in a Mixed–Flow Pump Impeller by Application of 3D Inverse Design Method: Part 1—Design And Numerical Validation", ASME Paper 94–GT–45, Jun. 1994.

Goto, A., Takemura T. and Zangeneh, M., "Suppression of Secondary Flows in a Mixed–Flow Pump Impeller by Application of 3D Inverse Design Method: Part 2—Experimental Validation", ASME Paper 94–GT–46, Jun. 1994.

Zangeneh, M., "Inverse Design of Centrifugal Compressor Vaned Diffusers in Inlet Shear Flows", ASME Paper 94–GT–144, Jun. 1994.

FIG. 7(A)

| Machine Type | Ns | No. | CPS-h | CPS-s | MSF_angle (deg.) |
|---|---|---|---|---|---|
| Pump | 280 | A | 0.200 | -0.250 | 19.9 |
| | | B | 0.235 | -0.082 | 19.2 |
| | | C | 0.350 | -0.175 | 17.5 |
| | △ | D | 0.300 | -0.358 | 15.3 |
| | | 1 | 0.185 | -0.345 | 15.3 |
| | | 2 | 0.317 | -0.386 | 15.2 |
| | 400 | E | 0.322 | -0.350 | 23.8 |
| | | F | 0.257 | -0.136 | 16.6 |
| | □ | G | 0.569 | -0.633 | 14.8 |
| | | H | 0.396 | -0.317 | 12.5 |
| | 560 | I | 0.281 | -0.516 | 39.1 |
| | | J | 0.190 | -0.537 | 28.7 |
| | | K | 0.227 | -0.562 | 28.4 |
| | | L | 0.094 | -1.102 | 22.0 |
| | | M | 0.178 | -0.853 | 15.3 |
| | | N | 0.251 | -0.713 | 14.6 |
| | ○ | 3 | 0.283 | -0.910 | 8.5 |
| | | 4 | 0.178 | -1.194 | 6.4 |
| | | 5 | 0.214 | -1.387 | STALL |
| | | 6 | 0.152 | -1.433 | STALL |
| | | O | 0.080 | -1.675 | STALL |

| Machine Type | Ns | No. | MS-h | MS-s | MSF_angle (deg.) |
|---|---|---|---|---|---|
| Compressor | 488 | P | 0.098 | -0.343 | 21.5 |
| | | 9 | 0.165 | -0.383 | 20.5 |
| | | Q | 0.340 | -0.125 | 19.1 |
| | | R | 0.300 | -0.295 | 14.8 |
| | ○ | S | 0.243 | -0.375 | 9.5 |
| | | T | 0.108 | -0.595 | 7.1 |
| | | U | 0.128 | -0.850 | STALL |
| | | 10 | 0.153 | -1.088 | STALL |

FIG. 7(B)

| Machine Type | Ns | No. | ΔCp*m-0.4 — ΔCp*m | MSF_angle (deg.) |
|---|---|---|---|---|
| Pump | 280 | A | 2.300 | 19.9 |
| | | B | 1.720 | 19.2 |
| | | C | 2.740 | 17.5 |
| | ○ | D | 3.950 | 15.3 |
| | | 1 | 4.020 | 15.3 |
| | | 2 | 4.950 | 15.2 |
| | 400 | E | 1.780 | 23.8 |
| | | F | 1.580 | 16.6 |
| | ○ | G | 3.260 | 14.8 |
| | | H | 2.730 | 12.5 |
| | 560 | I | 1.170 | 39.1 |
| | | J | 1.050 | 28.7 |
| | | K | 1.100 | 28.4 |
| | ○ | L | 1.550 | 22.0 |
| | | M | 1.470 | 15.3 |
| | | N | 1.560 | 14.6 |
| | | 3 | 1.970 | 8.5 |
| | | 4 | 2.020 | 6.4 |
| | | 5 | 2.620 | STALL |
| | ▲ | 6 | 2.350 | STALL |
| | | O | 2.560 | STALL |
| | 377 | 7 | 1.330 | STALL |
| | ■ | 8 | 1.705 | STALL |

| Machine Type | Ns | No. | MS-h | MSF_angle (deg.) |
|---|---|---|---|---|
| Compressor | 488 | P | 1.621 | 21.5 |
| | | 9 | 1.806 | 20.5 |
| | | Q | 1.365 | 19.1 |
| | ○ | R | 1.954 | 14.8 |
| | | S | 1.850 | 9.5 |
| | | T | 2.216 | 7.1 |
| | | U | 2.900 | STALL |
| | ▲ | 10 | 3.240 | STALL |

(A)

(B)

U

TURBOMACHINERY AND METHOD OF MANUFACTURING THE SAME

CROSS-REFERENCE TO RELATED APPLICATIONS

This is the national stage of International Application No. PCT/GB95/02904 filed Dec. 7, 1995.

TECHNICAL FIELD

The present invention relates to a turbomachinery and a method of manufacturing the turbomachinery which includes a centrifugal pump or a mixed flow pump for pumping liquid, a blower or a compressor for compression of gas, and more particularly to a turbomachinery having an impeller which has a fluid dynamically improved blade profile for suppressing a meridional component of secondary flow, and a method of manufacturing such a turbomachinery.

BACKGROUND ART

Conventionally, in flow channels of an impeller in a centrifugal or a mixed flow turbomachinery, main flows flowing along the flow channels are affected by secondary flows generated by movement of low energy fluid in boundary layers on wall surfaces due to static pressure gradients in the flow channels. This phenomenon leads to the formation of streamwise vortices or flows having non-uniform velocity in the flow channel, which in turn results in a substantial fluid energy loss not only in the impeller but also in the diffuser or guide vanes downstream of the impeller.

The secondary flow is defined as a flow which has a velocity component perpendicular to the main flow. The total energy loss caused by the secondary flows is referred to as the secondary flow loss. The low energy fluid accumulated at a certain region in the flow channel may cause flow separation on a large scale, thus producing a positively sloped characteristic curve and hence preventing stable operation of the turbomachine.

There is a known approach for suppressing the secondary flows in a turbomachine which is to make the impeller have a specific flow channel geometry. As an example of such approach using a specific flow channel geometry, there is a known method in which blades of the impeller in an axial turbomachine are leaned towards the circumferential direction thereof or the direction of the suction or the discharge side (L. H. Smith and H. Yeh, "Sweep and Dihedral Effects in Axial Flow Turbomachinery", Trans ASME, Journal of Basic Engineering, Vol. 85, No. 3, 1963, pp. 401–416), or a method in which blades in a turbine cascade are leaned or curved toward a circumferential direction thereof (W. Zhongqi, et al., "An Experimental Investigation into the Reasons of Reducing Secondary Flow Losses by Using Leaned Blades in Rectangular Turbine Cascades with Incidence Angle", ASME Paper 88-GT-4), or a method in which a radial rotor has a blade curvature in the spanwise direction with a convex blade pressure surface and/or a concave blade suction surface (GB2224083A). These methods are known to have a favorable influence upon the secondary flows in the flow channel if applied appropriately.

However, since the influence of the profile of a blade camber line or a blade cross-section upon the secondary flow has not been essentially known, the effect of blade lean or spanwise blade curvature is utilized under a certain limitation without changing the blade camber line or the blade cross-section substantially. Further, Japanese laid-open Patent Publication No. 60-10281 discloses a structure in which a projecting portion is provided at the corner of a hub surface and a blade surface in a turbomachine to reduce the secondary flow loss. Since such flow channel profile is a specific blade profile having a nonaxisymmetric hub surface, it is difficult to manufacture the impeller.

In all cases of the above prior art, the method of achieving the effect universally has not been sufficiently studied. Therefore, the universal methods of suppressing the secondary flows under different design conditions and for different types of turbomachines have not been established. Under these circumstances, there are many cases that the above effect is reduced, or to make matters worse, undesirable effects are obtained.

In general, the three-dimensional geometry of an impeller is defined as a meridional geometry formed by a hub surface and a shroud surface and a blade profile serving to transmit energy to fluid. As the meridional geometry, various geometries including a centrifugal type, a mixed flow type and an axial flow type are selected in accordance with design specifications, including flow rate, pressure head and rotational speed, which are required in the individual turbomachinery. As a type number characterizing the meridional geometry of an impeller, a specific speed $N_s=NQ^{1/2}/H^{3/4}$ (for pumps), is widely used for designing of the impeller. Here, N is the rotational speed in revolutions per minute (rpm), Q is the flow rate in cubic meters per minute ($m^3$/min) and H is the head in meters (m) representing fluid energy which is imparted to the fluid by the turbomachinery. That is, the specific speed is determined if the design specifications are given, and the meridional geometry of the impeller can be suitably selected in accordance with the specific speed. Incidentally, Q is defined as volume flow rate, and in case of a compressor or the like, the volume flow rate at an impeller inlet is used for a compressible fluid whose volume is variable between the impeller inlet and the impeller exit.

With regard to a blade profile, the inlet blade angle is determined by the assumed inlet velocity triangle at each spanwise location to match the inlet blade angle with the inlet flow angle. On the other hand, the exit blade angle is determined by the assumed exit velocity triangle at each spanwise location to satisfy the design head. The inlet and the exit velocity triangles are calculated from the meridional geometry and the design flow rate and the design head, but can be updated based on the results of flow calculations of the impeller. However, there are many degrees of freedom as to ways of determining blade angle distribution which controls inlet and exit blade angles, and in effect the choice of the blade angle distribution is left to designer's intuition.

There have been proposed up to now many methods in accordance with the approach which makes the impeller have a specific flow channel geometry to suppress the secondary flows. However, since the method of achieving the effect universally has not been sufficiently studied, design criterion of blade profiles having many degrees of freedom has not been established. Therefore, universal methods of suppressing the secondary flows under different design conditions and for different specific speeds have not been established. Under these circumstances, the three-dimensional geometry of the impeller has been designed on the basis of variation of blade angle distribution of the impeller by trial and error to find the optimum profile of the impeller for suppressing the secondary flow.

Next, a conventional method of designing the three-dimensional geometry of the impeller on the basis of variation of blade angle distribution by trial and error will be described below in accordance with a flow chart in FIG. 3(A).

In the first step (step of determining meridional plane), the design specification is input to determine the meridional geometry and the number of blades of the impeller. Next, a plurality of surfaces of revolution are defined on a meridional flow passage, and the tangential coordinate $f_0$ of a blade camber line at a point on each of surface of revolution is specified based on past experience. The location, where the tangential coordinate $f_0$ is specified, is selected at the leading edge or at the trailing edge of the impeller in many cases. Thus a specified location of the tangential coordinate $f_0$ is referred as the stacking condition.

In the second step (step of determining blade angle distribution), the blade angle at the impeller inlet is determined from the meridional geometry of the impeller obtained by the first step and design flow rate. Next, the blade angle at the impeller exit is determined from the meridional geometry of the impeller obtained by the first step, and design head. A curve which connects smoothly the determined blade angle at the impeller inlet and the blade angle at the impeller exit is defined to determine the blade angle distribution along the location of non-dimensional meridional distance m.

In the third step (step of determining a blade profile), tangential coordinate (wrap angle) of the blade camber line in each of the locations of non-dimensional meridional distance m is determined by integrating $\partial f/\partial m=1/(r \tan \beta)$ with the location of non-dimensional meridional distance m on the basis of blade angle distribution $\beta$ between the impeller inlet and the impeller exit along each stream line in the location of non-dimensional meridional distance m, using stacking condition $f_0$ as an initial value. The three-dimensional geometry of the impeller is determined by adding a certain thickness to the determined blade camber line to allow the blade to have mechanical strength.

In the fourth step (step of evaluating flow fields), three-dimensional inviscid flow analysis which is a flow analysis without consideration of viscosity of fluid is applied to the three-dimensional geometry of the impeller determined by the third step, and a possibility of poor performance caused by flow separation due to rapid deceleration of flow in the impeller is evaluated. In the case where it is judged that the pressure distribution in the impeller is not appropriate, after going back to the second step to modify the blade angle distribution, the steps from the second step to the fourth step are repeated until the expected result is achieved.

In case of suppressing the secondary flow by the above-mentioned conventional method of manufacturing the impeller, the following disadvantages are enumerated.

(1) In the fourth step, the criteria (including the dependence on the specific speed of the impeller) for judging whether optimum pressure distribution in the flow channel is achieved to suppress the secondary flow is uncertain. Though the state of generation of the secondary flows can be examined by three-dimensional viscous flow analysis, an enormous amount of calculations is required, thus optimization of the blade profile of the impeller by repeating the steps from the second step to the fourth step is practically not infeasible.

(2) Although it is necessary to make the blade angle distribution proper in the second step, if the blade angle distribution which achieves the secondary flow suppression deviates greatly from conventional experience, it is difficult to assume favorable blade angle distribution. Therefore, in practice, it has been difficult to find by trial and error the optimum blade profile of the impeller for suppressing secondary flow.

However, recently, as a design method of a blade profile of the impeller, it is known that if a blade loading distribution is given, the three-dimensional geometry of the impeller which realizes the given blade loading distribution can be determined by using a three-dimensional inverse design method which is published in the following literature.

Zangeneh, M., 1991, "A Compressible Three Dimensional Blade Design Method for Radial and Mixed Flow Turbomachinery Blades", International Journal of Numerical Methods in Fluids, Vol. 13, pp. 599–624., Borges, J. E., 1990, "A Three-Dimensional Inverse Method for Turbomachinery: Part I—Theory", Transaction of the ASME, Journal of Turbomachinery, Vol. 112, pp. 346–354, Yang, Y. L., Tan, C. S. and Hawthorne, W. R., 1992, "Aerodynamic Design of Turbomachinery Blading in Three-Dimensional Flow: An Application to Radial Inflow Turbines", ASME Paper 92-GT-74, Dang, T. Q., 1993, "A Fully Three-Dimensional Inverse Method for Turbomachinery Blading in Transonic Flows", Transactions of the ASME, Journal of Turbomachinery, Vol. 115, pp. 354–361, Borges, J. E., 1993 "A proposed Through-Flow Inverse Method for the Design of Mixed-Flow Pumps", International Journal for Numerical Methods in Fluids, Vol. 17, pp. 1097–1114.

Most of the above methods design the blade shape based on the three-dimensional inviscid flow through the blade channels. However, the method described by Borges (1993) uses a more approximate Actuator Duct approach in which the flow field is assumed to be axisymmetric. Such an approximate approach can provide a very computationally efficient means of arriving at the blade geometry for a specified loading distribution. However, the errors in this approach become quite high for very highly loaded turbomachines such as centrifugal pumps. Incidentally, in none of these literatures has the inverse design method been used for the purpose of suppression of secondary flows in an impeller.

It is apparent from the secondary flow theory that the secondary flow in the impeller results from the action of the Coriolis force caused by the rotation of the impeller and the effects of the streamline curvature. The secondary flow in the impeller is divided broadly into two categories, one of which is blade-to-blade secondary flow generated along a shroud surface or a hub surface, the other of which is the meridional component of secondary flow generated along the pressure surface or the suction surface of a blade.

It is known that the blade-to-blade secondary flow can be minimized by making the blade profile to be backswept. Regarding the other type of secondary flow, that is, the meridional component of secondary flow, it is difficult to weaken or eliminate it easily. If we wish to weaken or eliminate the meridional component of secondary flow, it is necessary to optimize the three-dimensional geometry of the flow channel very carefully.

The purpose of the present invention is to suppress the meridional component of secondary flow in a centrifugal or a mixed flow turbomachine.

As an example of a typical impeller in the turbomachinery to which the present invention is applied, the three-dimensional geometry of a closed type impeller is schematically shown in FIGS. 1(A) and 1(B) in such a state that most of a shroud surface is removed. FIG. 1(A) is a perspective view partly in section, and FIG. 1(B) is a cross-sectional view taken along a line A-A' which is a meridional cross-sectional view. In FIGS. 1(A) and 1(B), a hub surface 2 extends radially outwardly from a rotating shaft 1 so that it has a curved surface similar to a corn surface. A plurality of blades 3 are provided on the hub surface 2 so that they extend radially outward from the rotating shaft 1 and are disposed at equal intervals in the circumferential direction. The blade tips 3*a* of the blades 3 are covered with a shroud surface 4 as shown in FIG. 1(B). A flow channel is defined by two blades 3 in confrontation with each other, the hub surface 2 and the shroud surface 4 so that fluid flows from an impeller inlet 6*a* toward an impeller exit 6*b*. When the impeller 6 is rotated about an axis of the rotating shaft 1 at an angular velocity ω, fluid flowing into the flow channel form the impeller inlet 6*a* is delivered toward the impeller exit 6*b* of the impeller 6. In this case, the surface facing the rotational direction is the pressure surface 3*b*, and the opposite side of the pressure surface 3*b* is the suction surface 3*c*. In the case of open type impeller, there is no independent part for forming the shroud surface 4, but a casing (not shown in the drawing) for enclosing the impeller 6 serves as the shroud surface 4. Therefore, there is no basic fluid dynamical difference between the open type impeller and the closed type impeller in terms of the generation and the suppression of the meridional component of secondary flows, thus only the closed type impeller will be described below.

The impeller 6 having a plurality of blades 3 is incorporated as a main component, the rotating shaft 1 is coupled to a driving source, thereby jointly constituting a turbomachine. Fluid is introduced into the impeller inlet 6*a* through a suction pipe, pumped by the impeller 6 and discharged from the impeller exit 6*b*, and then delivered through a discharge pipe to the outside of the turbomachine.

The unsolved serious problem in connection with the impeller of a turbomachine is the suppression of the meridional component of secondary flow. The mechanism of generation of the meridional component of secondary flow, whose suppression is the purpose of this invention, is explained as follows:

As shown in FIG. 1(B), with regard to the relative flow, the reduced static pressure distribution, defined as $p^*=p-0.5\rho u^2$, is formed by the action of a centrifugal force $W^2/R$ due to streamline curvature of the main flow and the action of Coriolis force $2\omega W_\theta$ due to the rotation of the impeller, where W is the relative velocity of flow, R is the radius of streamline curvature, ω is the angular velocity of the impeller, $W_\theta$ is the component in the circumferential direction of W relative to the rotating shaft 1, $p^*$ is reduced static pressure, p is static pressure, ρ is density of fluid, us is peripheral velocity at a certain radius r from the rotating shaft 1. The reduced static pressure $p^*$ has such a distribution in which the pressure is high at the hub side and low at the shroud side, so that the pressure gradient balances the centrifugal force $W^2/R$ and the Coriolis force $2\omega W_\theta$ directed toward the hub side.

In the boundary layer along the blade surface, since the relative velocity W is reduced in the boundary layer developing along the wall surface, the centrifugal force $W^2/R$ and the Coriolis force $2\omega W_\theta$ acting on the fluid in the boundary layer become small. As a result, they cannot balance the reduced static pressure gradient of the main flow, and low energy fluid in the boundary layer flows towards an area of low reduced static pressure $p^*$, thus generating the meridional component of secondary flow. That is, as shown in broken lines on the pressure surface 3*b* and in solid lines on the suction surface 3*c* in FIG. 1(A), fluid moves along the blade surface from the hub side towards the shroud side on the pressure surface 3*b* and the suction surface 3*c* forming meridional component of secondary flow.

The meridional component of secondary flow is generated on both surfaces of the suction surface 3*c* and the pressure surface 3*b*. In general, since the boundary layer on the suction surface 3*c* is thicker than that on the pressure surface 3*b*, the secondary flow on the suction surface 3*c* has a greater influence on performance characteristics of turbomachinery. The purpose of the present invention is to suppress the meridional component of secondary flow in the suction surface of the blade.

When low energy fluid in the boundary layer moves from the hub side to the shroud side, fluid flow is formed from the shroud side to the hub side at around the midpoint location to compensate for fluid flow rate which has moved. As a result, as shown schematically in FIG. 2(B) which is a cross-sectional view taken along a line B-B' in FIG. 2(A), a pair of vortices which have a different swirl direction from each other are formed in the flow channel between two blades as the flow goes towards exit. These vortices are referred to as secondary vortices. Low energy fluid in the flow channel is accumulated due to these vortices at a certain location of the impeller towards the exit where the reduced static pressure $p^*$ is lowest, and this low energy fluid is mixed with fluid which flows steadily in the flow channel, resulting in generation of a great flow loss.

Furthermore, when the non-uniform flow generated by insufficient mixing of a low relative velocity (high loss) fluid and a high relative velocity (high loss) fluid is discharged to the downstream flow channel of the blades, a great flow loss is generated when both fluids are mixed.

Such a non-uniform flow leaving the impeller makes the velocity triangle unfavorable at the inlet of the diffuser and causes flow separation on diffuser vanes or a reverse flow within a vaneless diffuser, resulting in a substantial decrease of the overall performance of the turbomachine.

Furthermore, in the area of high loss fluid accumulated at a certain location in the flow channel, a large scale reverse flow is liable to occur, thus producing a positively sloped characteristics curve. As a result, surging, vibration, noise and the like are generated, and the turbomachinery cannot be stably operated especially at partial flow rate.

Therefore, in order to improve the performance of centrifugal or mixed flow turbomachinery and realize stable operation of turbomachinery, it is necessary to design the three-dimensional geometry of the flow channel for suppressing the secondary flow as much as possible, whereby the formation of secondary vortices, the resulting non-uniform flow, and large scale flow separation or the like may be prevented.

SUMMARY OF THE INVENTION

It is therefore an object of the present invention to overcome the drawbacks of increase of loss and unstable operation of turbomachinery caused by insufficient suppression of the meridional component of secondary flow in the impeller, and to provide the following four design aspects by which the blade profile of the impeller in the turbomachinery is designed using the three-dimensional inverse design method and the impeller having such blade profile is manufactured to thus reduce the above loss and improve stability of operation of the turbomachinery.

(1) According to the first aspect of the present invention, there is provided a turbomachinery having an impeller, characterized in that the impeller is designed so that the reduced static pressure difference ΔCp or the relative Mach number difference ΔM between the hub and the shroud on the suction surface of a blade shows a remarkable decreasing tendency along the location of non-dimensional meridional distance m toward the impeller exit. Here, non-dimensional meridional distance is defined on the meridional plane of the impeller as shown in FIG. 1(B). At the shroud, the non-dimensional meridional distance m is defined as $m=1_g/1_{T.S}$, which represents the ration of meridional distance $1_g$, measured from the blade inlet 6*a* along the shroud, to the meridional distance $1_{T.S.}$, between the impeller inlet 6*a* and the impeller exit 6*b* measured along the shroud. Similarly, at the hub, the non-dimensional meridional distance m is defined as $m=1_H/1_{T.H.}$, which represents the ration of meridional distance $1_H$, measured from the blade inlet 6*a* along the hub, to the meridional distance $1_{T.H.}$, between the impeller inlet 6*a* and the impeller exit 6*b* measured along the hub. So, m−0 corresponds to the impeller inlet 6*a,* and m=1.0 the impeller exit 6*b.*

With respect to the distribution of the reduced static pressure difference ΔCp, in order to ensure such remarkable decreasing tendency, as shown in FIGS. 4 and 8, the difference D between a minimum value ΔCpm of reduced static pressure difference ΔCp and a value $\Delta Cp_{m-0.4}$ of reduced static pressure difference ΔCp at the location corresponding to non-dimensional meridional distance mm−0.4 obtained by subtracting non-dimensional meridional distance 0.4 from non-dimensional meridional distance mm representing the above minimum value ΔCpm is selected to be not less than a specified value which is dependent on a specific speed Ns of the turbomachinery. In this case, from the viewpoint of secondary flow suppression in the impeller, the difference $D_{280}$ is preferably selected to be not less than 0.20 at the specific speed Ns=280, the difference $D_{400}$ is preferably selected to be not less than 0.28 at the specific speed Ns=400, and the difference $D_{560}$ is preferably selected to be not less than 0.35 at the specific speed Ns=560. Further, in order to prevent a flow separation at the location after non-dimensional meridional distance mm−0.4 at which the value $\Delta Cp_{m-0.4}$ of reduced static pressure difference ΔCp emerges, the pressure coefficient slope at the shroud side CPS-s on the suction surface of the blade is selected to be not less than −1.3 as the lower limit of the pressure coefficient slope at the shroud side CPS-s, $_{LIM}$. Here, the pressure coefficient slope at the shroud side CPS-s on the suction surface of the blade is defined as a pressure gradient on the shroud surface at the location between the non-dimensional meridional distance mm representing the above minimum value ΔCpm of reduced static pressure difference ΔCp and the non-dimensional meridional distance mm−0.4 obtained by subtracting non-dimensional meridional distance 0.4 from non-dimensional meridional distance mm representing the above minimum value ΔCpm. By selecting specifically this pressure coefficient slope at the shroud side CPS-s on the suction surface of the blade, the flow separation can be prevented in the downstream side of the location of non-dimensional meridional distance mm−0.4. In order to prevent the flow separation in the overall area of non-dimensional meridional distance m from the impeller inlet to the impeller exit, especially, in the upstream side of the location of non-dimensional meridional distance mm−0.4, the non-dimensional meridional distance mm representing the minimum value ΔCpm of reduced static pressure difference ΔCp is preferably selected to be in the range of non-dimensional meridional distance m=0.8–1.0.

This selection of the location of non-dimensional meridional distance mm representing the minimum value ΔCpm of reduced static pressure difference ΔCp prevents the gradient of the pressure coefficient curve along non-dimensional meridional distance m from becoming steep beyond a certain limit at which the flow separation may be generated.

Further, with respect to the distribution of the relative Mach number difference ΔM between the hub and the shroud on the suction surface of the blade, in order to ensure such remarkable decreasing tendency, as shown in FIGS. 5 and 24, the difference DM between a minimum value ΔMm of relative Mach number difference ΔM and a value $\Delta M_{m-0.4}$ of relative Mach number difference ΔM at the location corresponding to non-dimensional meridional distance mm−0.4 obtained by subtracting non-dimensional meridional distance 0.4 from non-dimensional meridional distance mm representing the above minimum value ΔMm is selected to be not less than a specified value which is dependent on a specific speed Ns of the turbomachinery. In this case, the difference $DM_{488}$ is selected to be not less than 0.23 at the specific speed Ns=488. Further, in order to prevent a flow separation at the location after non-dimensional meridional distance mm−0.4 at which the value $\Delta M_{m-0.4}$ of relative Mach number difference ΔM emerges, the Mach number slope at the shroud side MS-s is selected to be not less than −0.8 as the lower limit of the Mach number slope at the shroud side MS-s, $_{LIM}$. Here, the Mach number slope at the shroud side MS-s on the suction surface of the blade is defined as a gradient of Mach number on the shroud surface at the location between the non-dimensional meridional distance mm representing the above minimum value ΔMm of relative Mach number difference ΔM and the non-dimensional meridional distance mm−0.4 obtained by subtracting non-dimensional meridional distance 0.4 from non-dimensional meridional distance mm representing the above minimum value.

By selecting specifically this Mach number slope at the shroud side MS-s on the suction surface of the blade, the flow separation can be prevented in the downstream side of the location of non-dimensional meridional distance mm−0.4. In order to prevent the flow separation in the overall area of non-dimensional meridional distance m from the impeller inlet to the impeller exit, especially, in the upstream side of the location of non-dimensional meridional distance mm−0.4, the non-dimensional meridional distance mm representing the minimum value ΔMm of relative Mach number ΔM is preferably selected to be in the range on non-dimensional meridional distance m=0.8–1.0.

According to the first aspect of the present invention, while selecting properly by trial and error the distribution of the meridional derivative of $r\overline{V}_\theta$, i.e. blade loading distribution $\partial(r\overline{V}_\theta)/\partial m$ along the meridional distance m on the basis of the known close relationship between the pressure coefficient Cp and the angular momentum $r\overline{V}_\theta$, the pressure coefficient Cp is increased or decreased. And, by utilizing the known three-dimensional inverse design method using the blade loading distribution as input data, the impeller is designed so that the above-mentioned characteristic decreasing tendency in the reduced static pressure difference ΔCp or the relative Mach number difference ΔM between the hub and the shroud on the suction surface of the blade is realized, and further the above-mentioned characteristic limit in the pressure coefficient slope at the shroud side CPS-s or the Mach number slope at the shroud side MS-s on the suction surface of the blade is realized.

In the turbomachinery having the impeller with the three-dimensional geometry obtained by the above design method, the meridional component of secondary flow can be remarkably suppressed around and after the location of non-dimensional meridional distance mm−0.4 where the reduced static pressure difference ΔCp or the relative Mach number difference ΔM shows a remarkably decreasing tendency toward the impeller exit. As a result, the meridional component of secondary flow can be effectively suppressed in the overall area of the impeller.

(2) According to the second aspect of the present invention, the distribution of the reduce static pressure difference ΔCp* along non-dimensional meridional distance m on the basis of the pressure coefficient Cp* which is normalized to clarify dependence on the specific speed Ns is characterized by a remarkable decreasing tendency toward the impeller exit.

According to the first aspect of the present invention, since the pressure coefficient Cp or the Mach number M, and thus the reduced static pressure difference ΔCp or the relative Mach number difference ΔM are not defined as a function of a specific speed Ns, dependence on numerical values of them on the specific speed is not quantitatively clarified. For example, it is difficult to estimate the difference D at the specific speeds except for the specific speeds illustrated in FIG. 4 in the turbomachinery such as pumps which handle incompressible fluid, or the difference DM at the specific speeds illustrated in FIG. 5 in the turbomachinery such as compressors which handle compressible fluid.

Therefore, according to the second aspect of the present invention, in order to solve the above drawbacks, instead of the pressure coefficient Cp or the Mach number M, and thus the reduced static pressure difference ΔCp or the relative Mach number difference ΔM, the normalized pressure coefficient Cp* is used, whereby the difference D* between a minimum value ΔCp*m of the normalized reduced static pressure difference ΔCp* and the normalized reduced static pressure difference $\Delta Cp^*_{m-0.4}$ at the location corresponding to non-dimensional meridional distance mm−0.4 obtained by subtracting non-dimensional meridional distance 0.4 from non-dimensional meridional distance mm representing the above minimum value ΔCp*m of the normalized reduced static pressure difference ΔCp* can be expressed as a function of the specific speed Ns, as shown in FIG. 6, which is defined by the following equation:

$$D^*=-0.004Ns+3.62$$

Therefore, in order to suppress the secondary flow in the impeller, for example, the difference $D_{500}$ is preferably selected to be not less than 1.62 at the specific speed Ns=500, the difference $D_{400}$ is preferably selected to be not less than 2.02 at the specific speed Ns=400, and the difference $D_{300}$ is preferably selected to be not less than 2.42 at the specific speed Ns=300.

Here, the normalized pressure coefficient Cp* is defined as follows:

$Cp^*=Cp/Cp,$ mid-mid where Cp, mid-mid is a pressure coefficient in the center of flow channel (midspan and midpitch) at the location of non-dimensional meridional distance as shown in FIG. 1(D). Incidentally, the pressure coefficient Cp* in compressible fluid which is handled by the turbomachinery such as a compressor is expressed by the following equation.

$$Cp^*=2[1-(1-0.5W^2/H_0^*)^{\gamma/(\gamma-1)}]/\gamma M_0^{*2}$$

$$M_0^{*2}=Ut/(\gamma P_0^*/\rho_0^*)^{0.5}$$

where Ut is a peripheral speed of the impeller, W is a relative velocity, $H_0^*$ is a rothalpy, γ is a ratio of specific heat, $P_0^*$ is rotary stagnation pressure, and $\rho_0^*$ is a density corresponding to $P_0^*$.

According to the second aspect of the present invention, it is possible to select a wide range of specific speeds Ns in the turbomachinery and deal with every kind of fluid (compressible fluid and incompressible fluid) which is handled by the turbomachinery, and while selecting properly by trial and error the blade loading distribution along non-dimensional meridional distance m on the basis of the known close relationship between the pressure coefficient Cp and the angular momentum $r\overline{V}_s$, the pressure coefficient Cp* is increased or decreased. And, by utilizing the known three-dimensional inverse design method using the blade loading distribution as input data, the impeller is designed so that the above-mentioned characteristic deceasing tendency in the reduced static pressure difference ΔCp* between the hub and the shroud on the suction surface of the blade is realized.

In the turbomachinery having the impeller with the three-dimensional geometry obtained by the above design method, the meridional component of secondary flow can be remarkably suppressed after the location of non-dimensional meridional distance mm−0.4 where the normalized reduced static pressure difference ΔCp* shows a remarkably decreasing tendency toward the impeller exit. As a result, the meridional component of secondary flow can be effectively suppressed in the overall area of the impeller.

(3) According to the third aspect of the present invention, there is provided a method of designing and manufacturing the turbomachinery having the impeller with the three-dimensional geometry which realizes the distribution of the reduced static pressure difference ΔCp or the relative Mach number difference ΔM along non-dimensional distance m and is characterized by the first aspect of the present invention.

According to the fourth aspect of the present invention, there is provided a method of designing and manufacturing the turbomachinery having the impeller with the three-dimensional geometry which realizes the distribution of the reduced static pressure difference ΔCp* on the basis of the normalized pressure coefficient Cp* along non-dimensional distance m and is characterized by the second aspect of the present invention.

According to the third and fourth aspects of the present invention, while selecting properly by trial and error the blade loading distribution along non-dimensional meridional distance m on the basis of the known close relationship between the pressure coefficient Cp and the angular momentum $r\overline{V}_s$, the pressure coefficient Cp is increased or decreased, and by utilizing the known three-dimensional inverse design method using the blade loading distribution as input data, the three-dimensional geometry of the impeller which realizes the distribution characterizing the first and second aspects of the present invention is established.

In this case, the design method of the three-dimensional geometry of the impeller is processed in accordance with a flow chart in FIG. 3(B).

In the first step (step of determining meridional surface), the design specification is input to determine the meridional geometry of the impeller and the number of blades of the impeller. Next, a plurality of surfaces of revolution is defined in a meridional flow channel, and stacking condition $f_0$ representing tangential co-ordinate of blade camber line at a point on each of surfaces of revolution is determined.

In the second step (step of determining the specified loading distribution), the profile of the blade loading distribution $\partial(r\overline{V}_s)/\partial m$ is selected so that the blade loading distribution has a peak on the shroud surface in the first half of the location of non-dimensional meridional distance m and a peak on the hub surface in the latter half of the location of non-dimensional meridional distance m. Next, the value obtained by integration of the blade loading distribution along the non-dimensional distance m is adjusted to satisfy design head of the impeller, the distribution of blade loading $r\overline{V}_s$ along the location of non-dimensional meridional distance m is determined.

In the third step (step of determining blade profile), the blade shape is computed in an iterative manner by integrating $$\{(\overline{V}z+v_{zb1})\partial f/\partial z\}+\}(\overline{V}r+v_{rb1})\partial f/\partial r\}=\{(r\overline{V}_s)/r^2)\}+\{(v_{ab1})/r\}-\omega$$

along non-dimensional meridional distance m using stacking condition $f_o$ determined by the first step as an initial value. In the first iteration the equation is integrated by neglecting the periodic velocity terms ($v_{rb1}$, $v_{zb1}$, $v_{sb1}$) and using the approximate value for $\overline{V}r$ and $\overline{V}z$ and using $\overline{V}_s$ from the specified $r\overline{V}_s$ distribution. Integrating this equation the tangential co-ordinate of the blade camber line f along the non-dimensional meridional distance m is determined. The three-dimensional geometry of the impeller is then determined by adding a certain thickness to the determined blade camber line to allow the blade to have a required mechanical strength. The flow field in the blade channel is then calculated by solving the governing equation of the mean and tangentially periodic flow fields. The solution of the mean flow field governing equation then gives new values for $\overline{V}r$ and $\overline{V}z$, while from the solution of the periodic flow governing equation the velocity terms $v_{rb1}$, $v_{zb1}$ and $v_{sb1}$ are determined. Using these updated values the above equation is again integrated to find the new tangential co-ordinate of the blade camber line f along the non-dimensional meridional distance m. This process is repeated until the difference in blade camber line between one iteration and the next falls below a certain tolerance.

In the fourth step (step of evaluation of optimum reduced static pressure difference and the like), it is judged whether or not the distribution of the reduced static pressure difference ΔCp or the relative Mach number difference ΔM along non-dimensional meridional distance m which is computed in the third step is suitable for suppressing the secondary flow in the impeller.

In the fifth step (step of evaluating flow fields), a possibility of poor performance caused by a flow separation due to rapid deceleration of flow in the impeller determined by the third step is evaluated. Next, it is evaluated whether the secondary flow parameter is a satisfied value or not. In the case where it is judged that the pressure distribution in the impeller is not appropriate, after going back to the second step to modify the blade loading distribution, the steps from the second step to the fifth step are repeated until the expected result is achieved.

According to the method of manufacturing the turbomachinery of the third and fourth aspects, the blade loading distribution, which is directly related to characteristics of flow fields of D, DM or D* which is criteria of judgement in the fourth process, is determined and is used as input data for the third step for determining blade profile. Therefore an effective blade profile for suppressing secondary flow is promptly obtained, compared with the conventional manufacturing method using the blade angle distribution as a parameter related to the blade profile.

BRIEF DESCRIPTION OF DRAWINGS

FIGS. 1(A)–2(B) are views for explaining the background art;

FIGS. 1(A) through 1(E) are views for explaining the meridional component of secondary flow in three-dimensional geometry of a closed type impeller, FIG. 1(A) is a perspective view partly in section, FIG. 1(B) is a meridional cross-sectional view taken along line A-A' of FIG. 1(A), FIG. 1(C) is a view for explaining a computational mesh in three-dimensional viscous calculations, FIG. 1(D) is a perspective view showing midspan and midpitch of the impeller, and FIG. 1(E) is a view showing a blade profile of the impeller;

FIGS. 2(A) and 2(B) are views for explaining secondary vortices caused by the meridional component of secondary flow in the closed type impeller, FIG. 2(A) is a perspective view partly in section, and FIG. 2(B) is a cross-sectional view taken along line B-B' of FIG. 2(A);

FIG. 3(A) is a flow chart showing a conventional design method of designing the three-dimensional geometry of the impeller, and FIG. 3(B) is a flow chart showing a three-dimensional inverse design method which has been put to practical use recently, according to the present invention;

FIG. 7(A) is a table showing the pressure coefficient slope at the shroud side CPS-s and the pressure coefficient slope at the hub side CPS-h read from characteristic graphs in verification examples, and MSF-angle calculated as secondary flow parameter, and FIG. 7(B) is a table showing the difference D* on the basis of the normalized pressure coefficient Cp* shown in the same manner as FIG. 7(A);

FIG. 8 is a graph showing a verification example "A", FIG. 9 is a graph showing a verification example "B", FIG. 10 is a graph showing a verification example "C", FIG. 11 is a graph showing a verification example "D", FIG. 12 is a graph showing a verification example "E", FIG. 13 is a graph showing a verification example "F", FIG. 14 is a graph showing a verification example "G", FIG. 15 is a graph showing a verification example "H", FIG. 16 is a graph showing a verification example "I", FIG. 17 is a graph showing a verification example "J", FIG. 18 is a graph showing a verification example "K", FIG. 19 is a graph showing a verification example "L", FIG. 20 is a graph showing a verification example "M", FIG. 21 is a graph showing a verification example "N", and FIG. 22 is a graph showing a verification example "O";

FIG. 24 is a graph showing a verification example "P", FIG. 25 is a graph showing a verification example "Q", FIG. 26 is a graph showing a verification example "R", FIG. 27 is a graph showing a verification example "S", FIG. 28 is a graph showing a verification example "T", and FIG. 29 is a graph showing a verification example "U";

BEST MODE FOR CARRYING OUT THE INVENTION

An embodiment according to the first aspect of the present invention will be described below.

The influence of viscosity can be neglected for main flow of the relative flow in the flow channels of an impeller, therefore the following formula is approximately satisfied in incompressible flow as in a liquid pump.

$$P_0^*=p^*+0.5\rho W^2=\text{constant}$$

where $P_0^*$ is rotary stagnation pressure upstream of the impeller.

Next, as a non-dimensional quantity of reduced static pressure p* on the blade surface, pressure coefficient Cp is defined by the following equation:

$$Cp=(P_0^*-p^*)/(0.5\rho Ut^2)=(W/Ut)^2$$

where Ut represents the mean peripheral speed at the impeller exit.

As is apparent from the above equation, the pressure coefficient Cp is large at the shroud where reduced static pressure p* is low, and is small at the hub where reduced static pressure p* is high. As mentioned above, since the meridional component of secondary flow on the blade suction surface is directed to the shroud side having low reduced static pressure p* from the hub side having high reduced static pressure p*, suppression of the meridional component of secondary flow can be expected by reducing pressure difference ΔCp between them. Incidentally, in case of incompressible fluid, the pressure coefficient Cp is equal to $(W/Ut)^2$, where W is relative velocity. In compressible fluid as in a compressor, the physical variable related to the behavior of secondary flow is relatively Mach number. In order to simplify the description, only the distribution of the pressure coefficient Cp will be described below. The influence of distribution of the pressure coefficient Cp in incompressible flow upon the meridional component of secondary flow is equivalent to that of the relative Mach number M in compressible flow. Here, static pressure p or relative Mach number M is obtained through three-dimensional steady inviscid flow calculation.

Since the boundary layers on the blade surfaces which develop along the wall of the flow channel in the impeller increase their thickness cumulatively from the impeller inlet toward the impeller exit, the present invention proposes structure for suppressing the meridional component of secondary flow on the suction surface of the blade, considering distribution of the pressure coefficient Cp mainly in the latter half of the impeller. That is, the blade profile is designed so as to have the pressure distribution so that the pressure difference ΔCp between the shroud side and the hub side on the suction surface shows a remarkably decreasing tendency along the location of non-dimensional meridional distance m toward the impeller exit.

Figure 8:
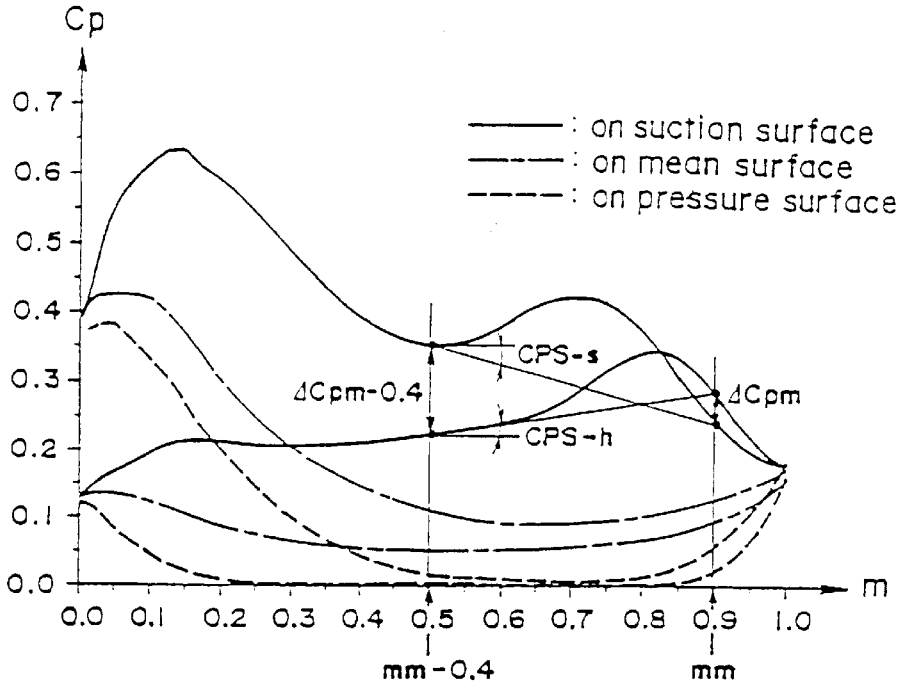
FIGS. 8 through 22 are characteristic graphs showing the distribution of the pressure coefficient Cp along non-dimensional meridional distance m of the blade.
Figure 9:
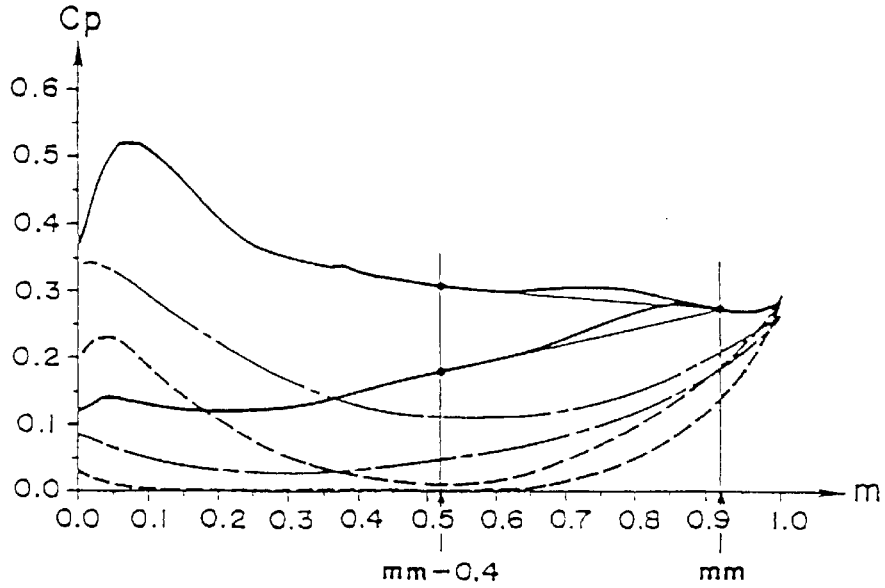
Figure 10:
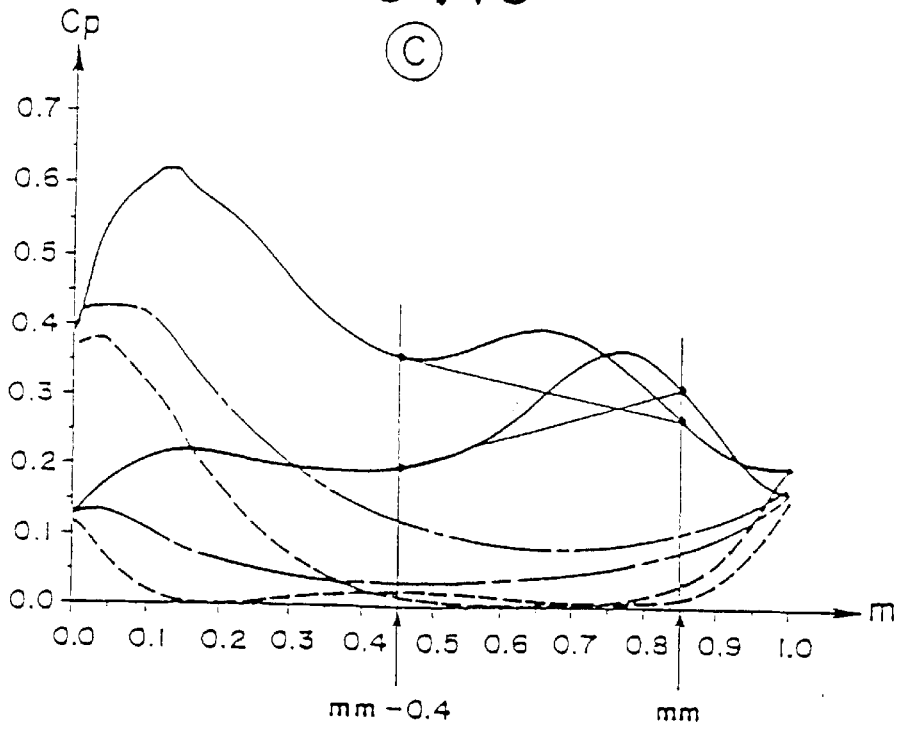
Figure 11:
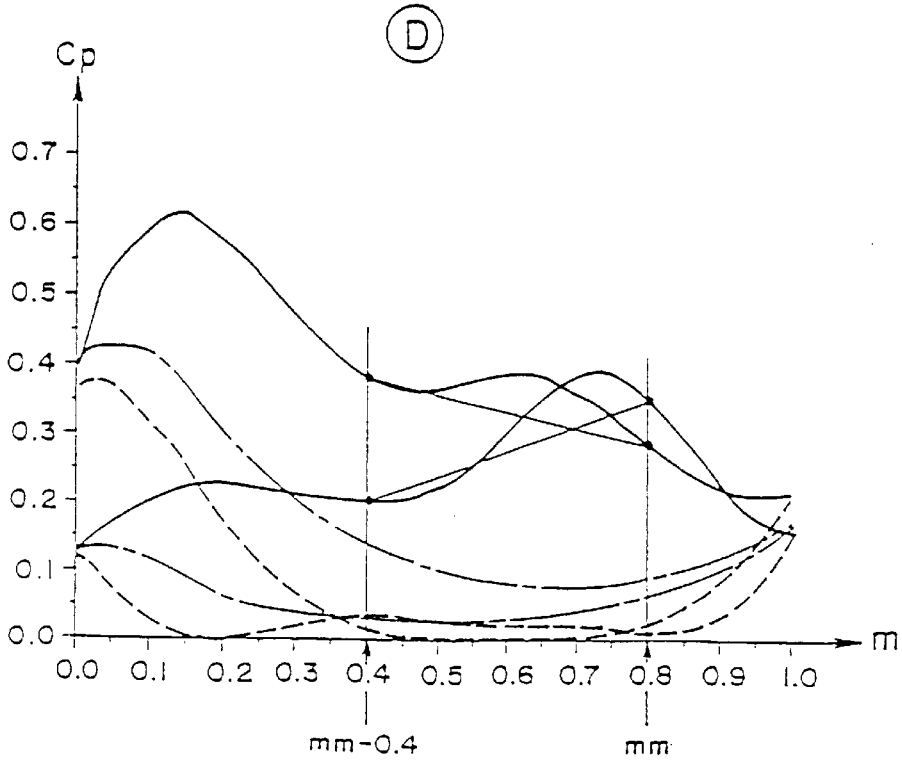
Figure 12:
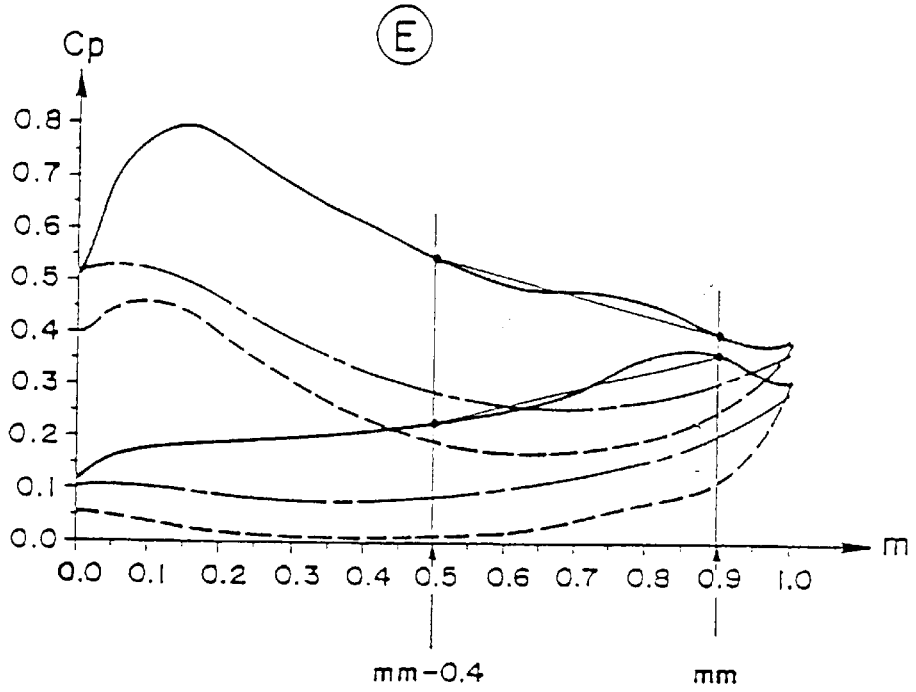
Figure 13:
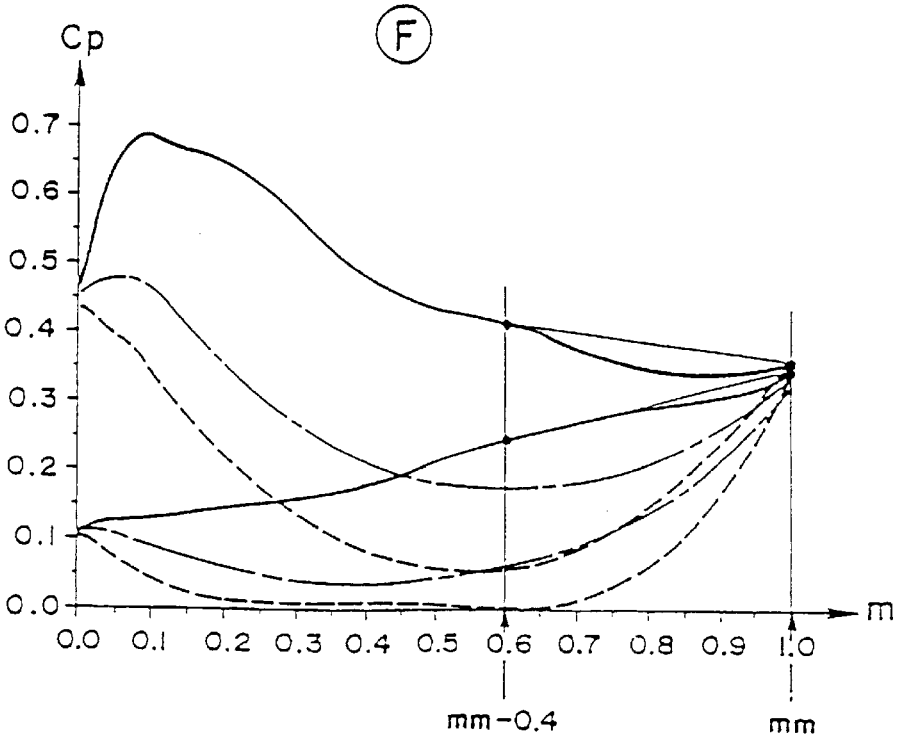
Figure 14:
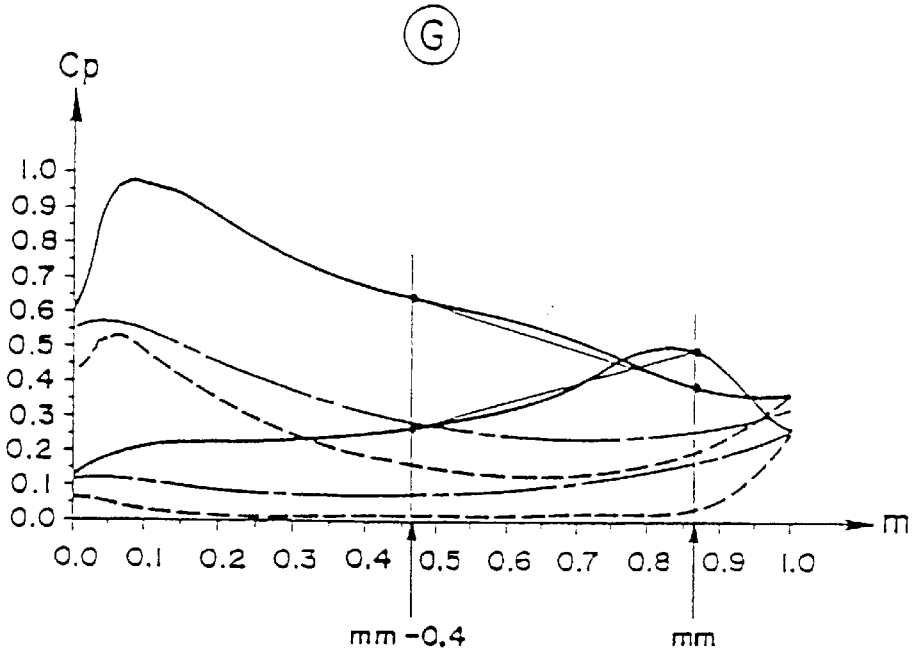
Figure 15:
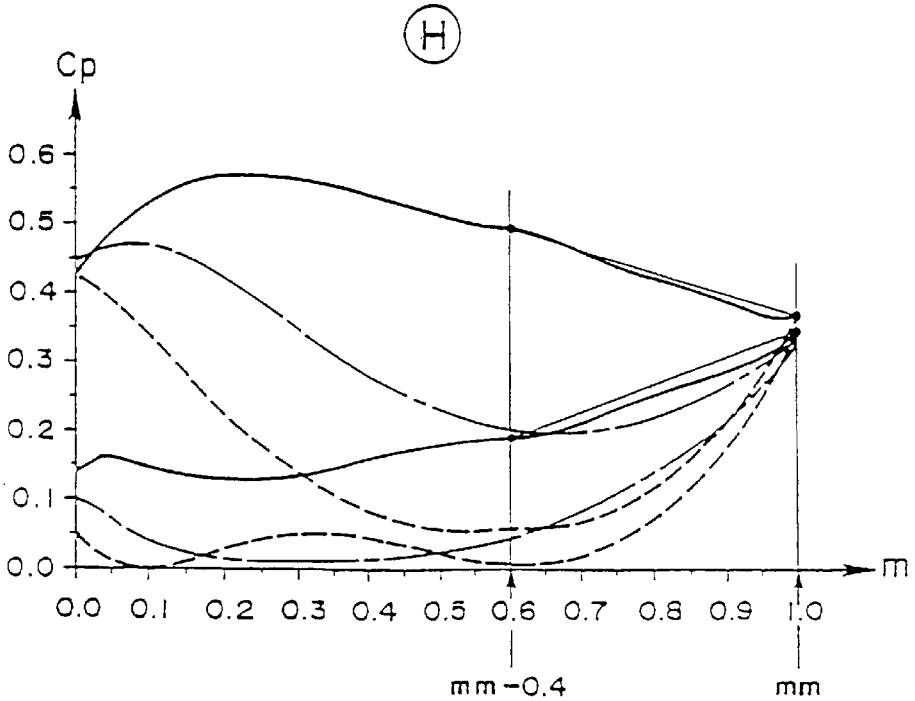
Figure 16:
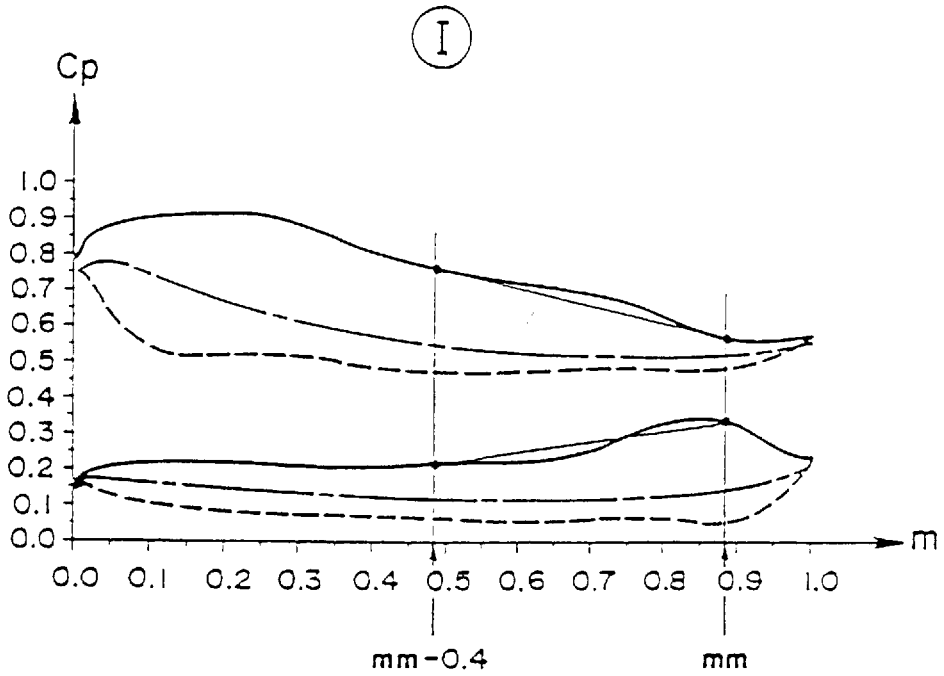
Figure 17:
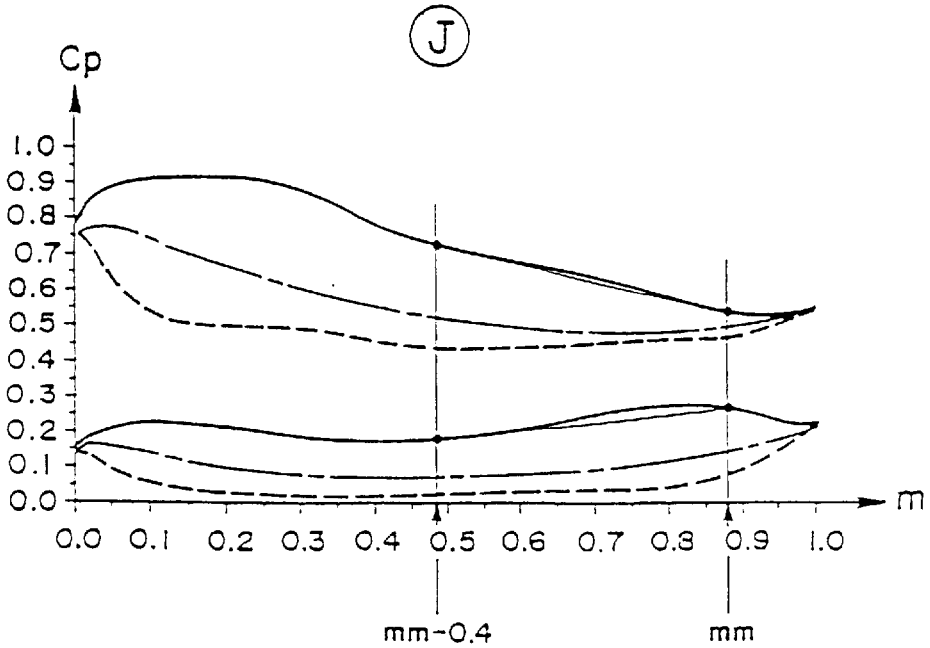
Figure 18:
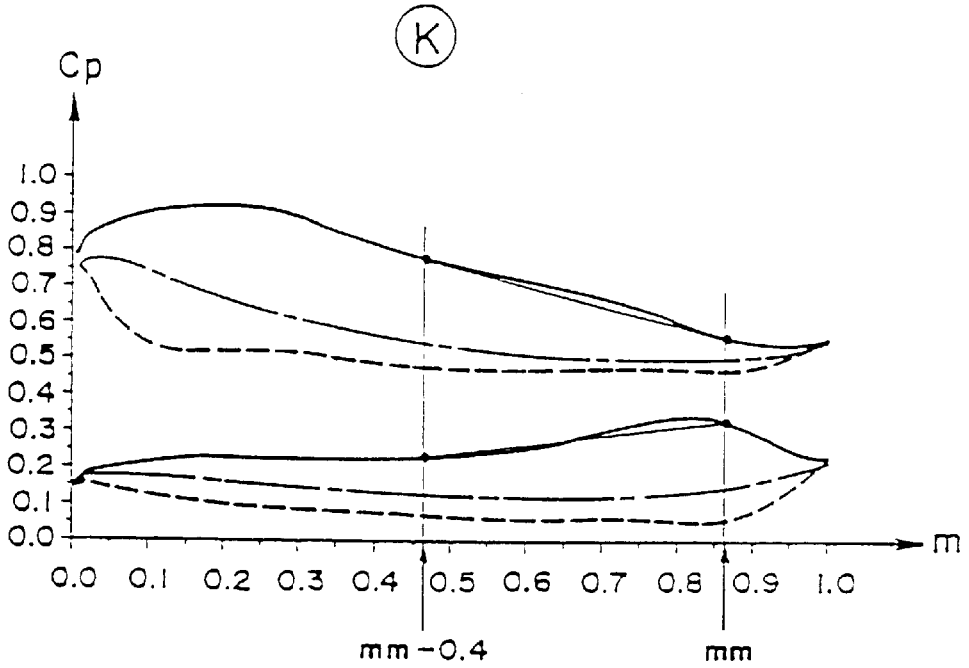
Figure 19:
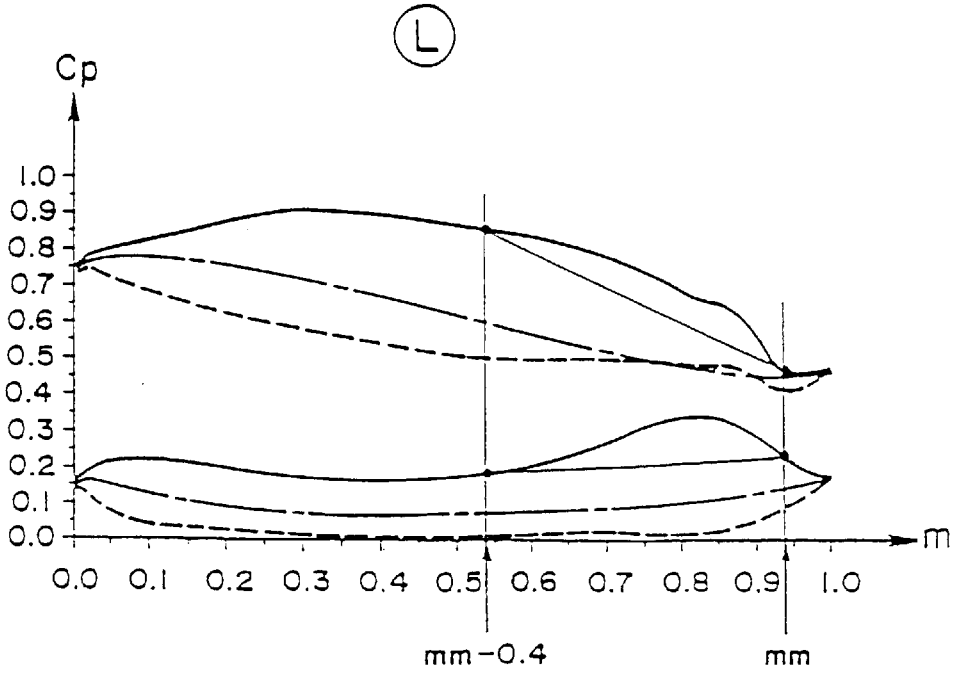
Figure 20:
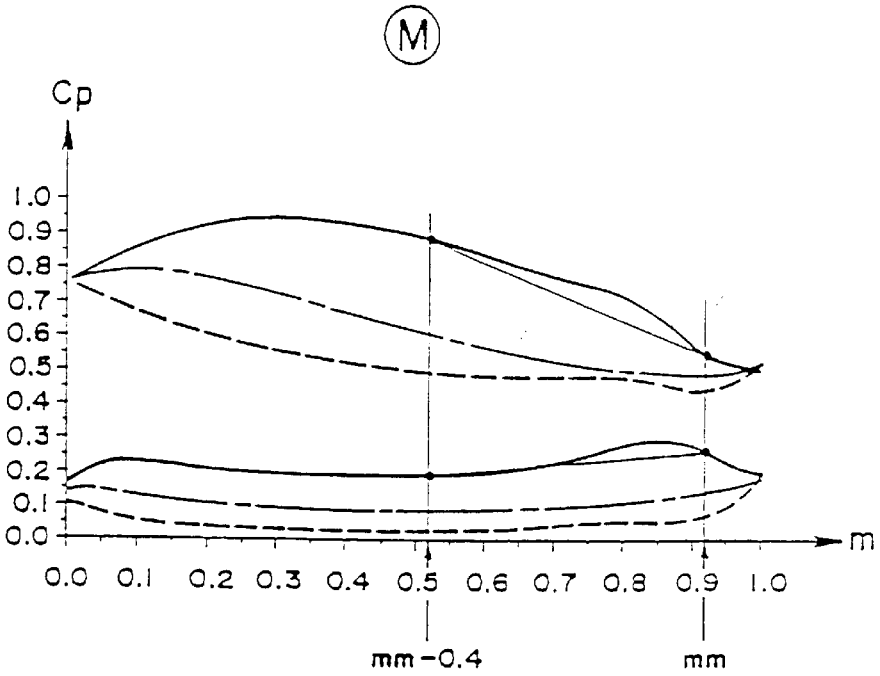
Figure 21:
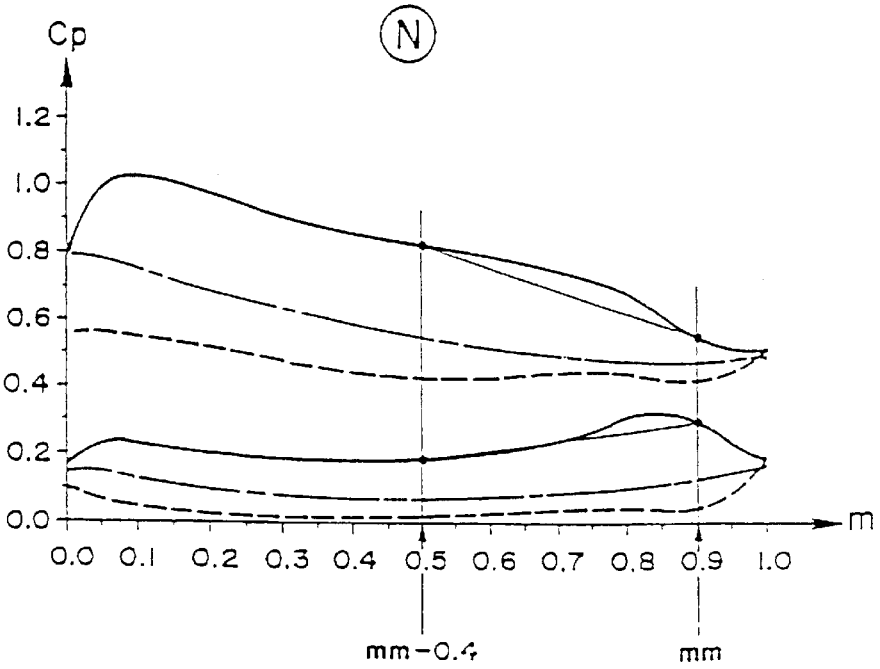
Figure 22:
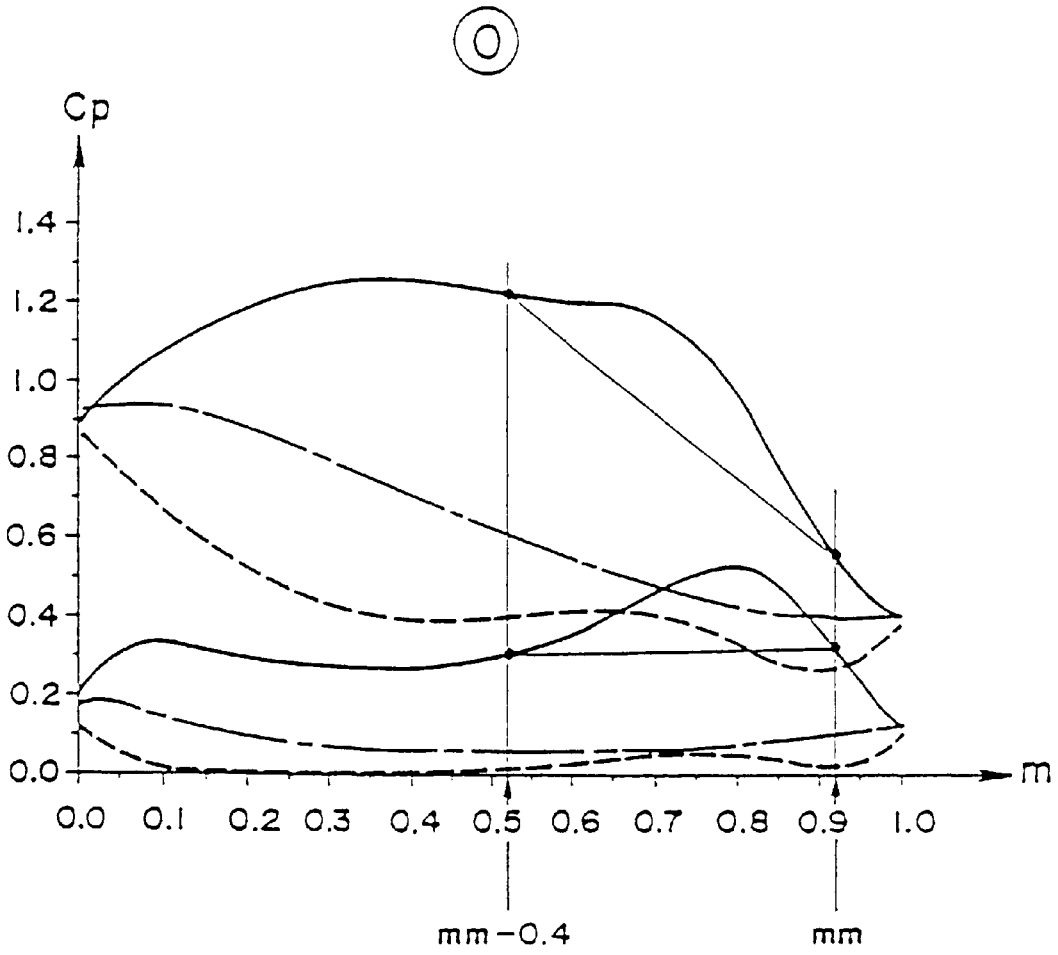

FIG. 8 is a characteristic graph showing distribution of the pressure coefficient Cp obtained by the three-dimensional steady inviscid flow calculations, and thus the reduced static pressure difference ΔCp of a pump according to a best mode of the first aspect of the present invention. In FIG. 8, the vertical axis represents the pressure coefficient Cp, and the horizontal axis represents the location between non-dimensional meridional distance m=0 (impeller inlet) and non-dimensional meridional distance m=1.0 (impeller exit). In FIG. 8, a solid curve at the upper part of the graph shows a pressure coefficient curve representing values of the pressure coefficient on the suction surface of the blade at the shroud side along the location of non-dimensional meridional distance m, and an alternative long and short dash curve extending substantially along the above solid line shows values of the pressure coefficient at the midpitch location on the shroud surface.

On the other hand, in FIG. 8, a solid curve at the lower part of the graph shows a pressure coefficient curve representing values of the pressure coefficient on the suction surface of the blade at the hub side along the location of non-dimensional meridional distance m, and an alternative long and short dash curve extending substantially along the above solid line shows values of the pressure coefficient at the midpitch location on the hub surface.

Broken line curves show the pressure coefficient on the pressure surface of the blade at the shroud and hub sides, respectively. These curves are not directly related to the present invention, but are depicted for reference.

In FIG. 8, the distance between the solid curves adjacent to each other along the vertical axis, i.e. the difference between a value on the pressure coefficient curve at the shroud side and a value on the pressure coefficient curve at the hub side at the same location of non-dimensional meridional distance m corresponds to the reduced static pressure difference ΔCp. The location of non-dimensional meridional distance mm at which a minimum value ΔCpm (in case of a negative value, a maximum value of absolute value) of reduced static pressure difference ΔCp emerges is defined on the horizontal axis, and the location which approaches the impeller inlet (m=0) by non-dimensional meridional distance 0.4 from the location of non-dimensional meridional distance mm, that is: the location corresponding to non-dimensional meridional distance mm−0.4 obtained by subtracting non-dimensional meridional distance 0.4 from non-dimensional meridional distance mm representing the above minimum value ΔCpm is defined.

Here, the gradient of inclined straight line which connects the value $C_{s.m-0.4}$ on the pressure coefficient curve on the shroud surface at the location of non-dimensional meridional distance mm−0.4 and the value $Cp_{s.m}$ on the pressure coefficient curve on the shroud surface at the location of non-dimensional meridional distance mm, i.e. $(Cp_{s.m}-Cp_{s.m-0.4})/0.4$ is defined as a pressure coefficient slope at the shroud side CPS-s. In the example of FIG. 8, the pressure coefficient slope at the shroud side CPS-s is negative. Similarly, the gradient of straight line which connects the value $Cp_{h.m-0.4}$ on the pressure coefficient curve on the hub surface at the location of non-dimensional meridional distance mm−0.4 and the value $Cp_{h.m}$ on the pressure coefficient curve on the hub surface at the location of non-dimensional meridional distance mm, i.e. $(Cp_{h.m}-Cp_{h.m-0.4})/0.4$ is defined as pressure coefficient gradient at the hub side CPS-h. In the example of FIG. 8, the pressure coefficient slope at the hub side CPS-h is positive.

Figure 4:
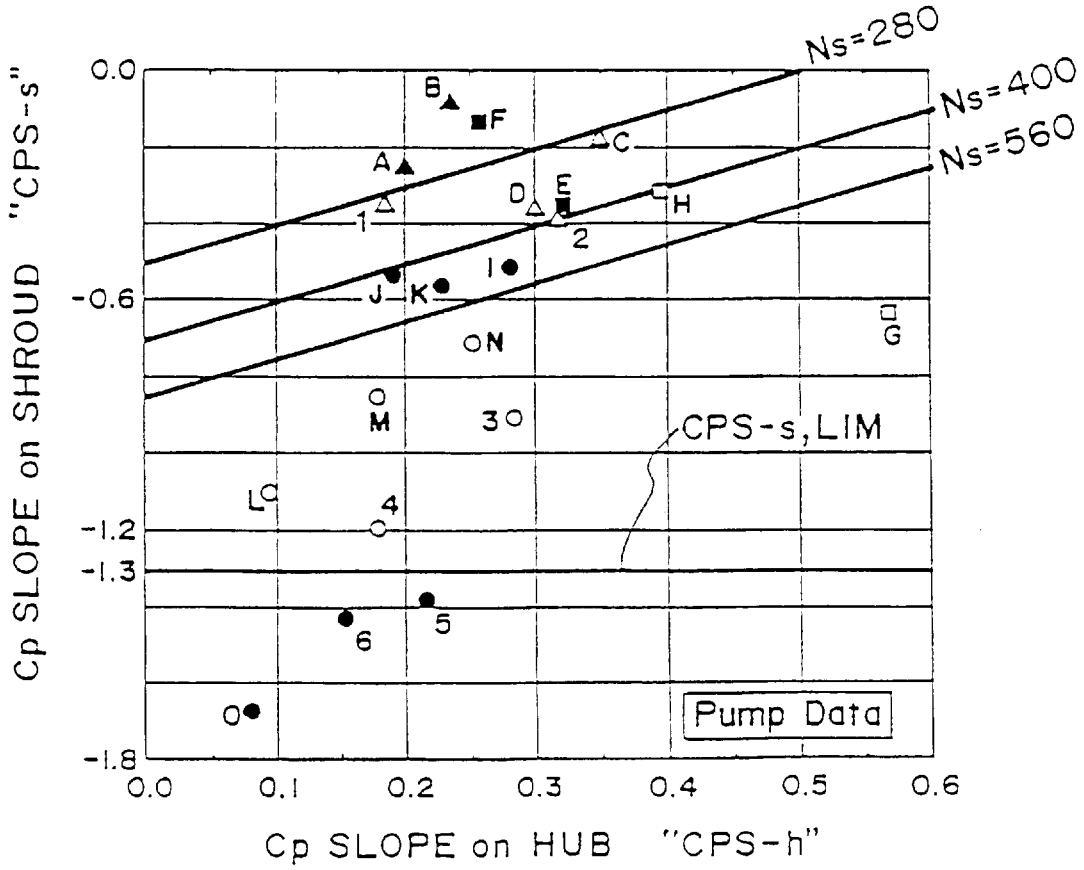
FIG. 4 is a graph showing verification data plotted on the plane defined by a vertical axis representing the pressure coefficient slope at the shroud side CPS-s and a horizontal axis representing the pressure coefficient slope at the hub side CPS-h, and further showing boundary lines defined by specific speeds Ns and the lower limit of the pressure coefficient slope at the shroud side CPS-$s_{,LIM}$.

It was confirmed on the basis of many verification examples by the inventors of the present invention that the difference between the value on the pressure coefficient curve at the shroud side at the location of non-dimensional meridional distance mm−0.4 and the value on the pressure coefficient curve at the hub side at the location of non-dimensional meridional distance mm−0.4, that is, the difference D between the reduced static pressure difference $\Delta Cp_{m-0.4}$ at the location of non-dimensional distance mm−0.4 and the minimum value ΔCpm of the reduced static pressure difference ΔCp is the essential factor which governs suppression of the secondary flow in the impeller of the turbomachinery. Here, the difference D is derived from cooperative contribution of the pressure coefficient slope at the shroud side CPS-s and the pressure coefficient slope at the hub side CPS-h, thus the differences D between the reduced static pressure difference $\Delta Cp_{m-0.4}$ at the location of non-dimensional meridional distance mm−0.4 and the minimum value ΔCpm of the reduced static pressure difference ΔCp in principal verification examples were plotted in FIG. 4 on the plane defined by horizontal and vertical axes representing the above respective slopes or gradients. In FIG. 4, the vertical axis represents the pressure coefficient slope at the shroud side CPS-s, and the horizontal axis represents the pressure coefficient slope at the hub side CPS-h. In FIG. 4, Δ represent verification examples of pumps of a specific speed Ns=280, □ represent verification examples of pumps of a specific speed Ns=400, and 0 represent verification examples of pumps of a specific speed Ns=560. Further, open symbols (Δ, □, 0) represent adaptation to the quantitative criterion (describe latter) of judgement about suppression of the secondary flow, and solid symbols (▲, ■, ⬮) represent nonadaptation to the above criterion.

FIG. 7(A) is a table showing data in principal verification examples. FIG. 7(A) includes six verification examples A, B, C, D, 1 and 2 in pumps of a specific speed Ns=280. Concerning four examples A, B, C and D, four pairs of data as to values of the pressure coefficient slope at the shroud side CPS-s and the pressure coefficient slope at the hub side CPS-h were read from the pressure coefficient curves of the verification examples shown in FIGS. 8 through 11 in the order of A, B, C and D, and four Δ symbols were plotted on the plane between two axes from the readings. Concerning two examples 1 and 2, the pressure coefficient curves in the verification examples are not shown, but the resultant data were represented for reference as a part of large amount of other verification examples.

Four verification examples A, B, C and D in pumps of a specific speed Ns=400 are the same as the above. Four pairs of data as to values of the pressure coefficient slope at the shroud side CPS-s and the pressure coefficient slope at the hub side CPS-h were read from the pressure coefficient curves of the verification examples shown in FIGS. 12 through 15 in the order of E, F, G and H, and four □ symbols were plotted in FIG. 4. Further, six verification examples I, J, K, L, M and N in pumps of a specific speed Ns=560 are the same as the above. Data concerning values of the pressure coefficient slope at the shroud side CPS-s and the pressure coefficient slope at the hub side CPS-h were read from the pressure coefficient curves of the verification examples shown in FIGS. 16 through 21 in the order of I, J, K, L, M and N, and six O symbols were plotted in FIG. 4. Concerning verification examples 3, 4, 5, 6 and O, the resultant data were represented for reference.

In the plotted data in FIG. 4, as described above, open and solid symbols represent adaptation or nonadaptation to the quantitative criterion of judgement about suppression of the secondary flow. The quantitative criterion of judgement will be described below.

Figure 1A:
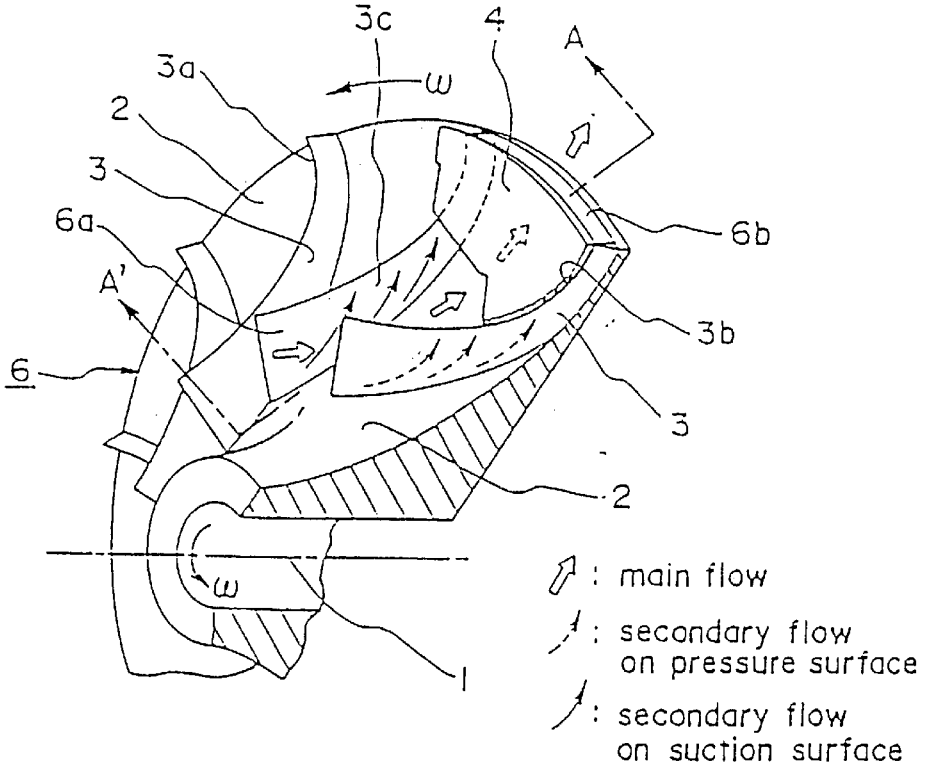
FIG. 1(A) PRIOR ART
Figure 1B:
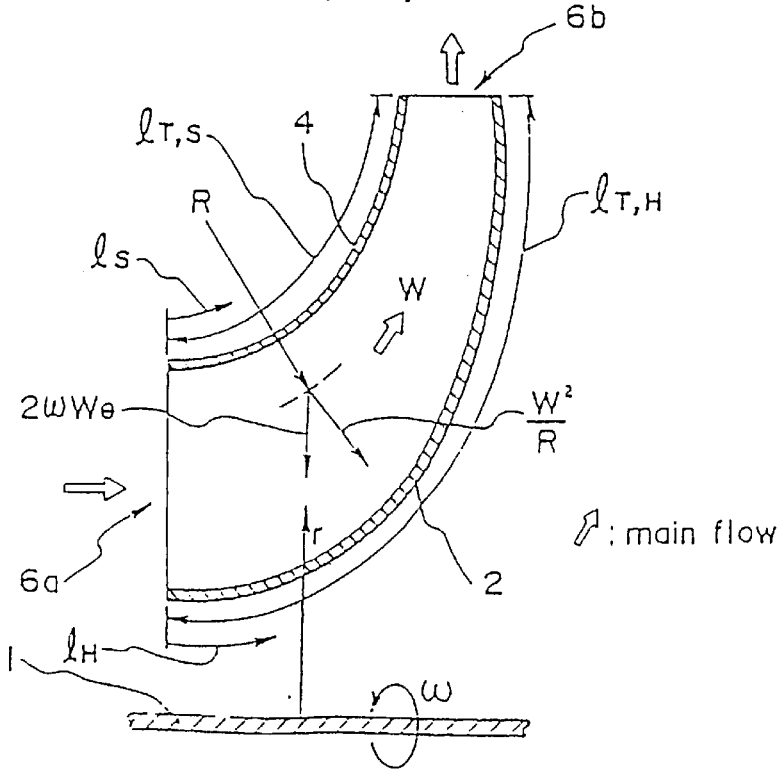
FIG. 1(B) PRIOR ART
Figure 1C:
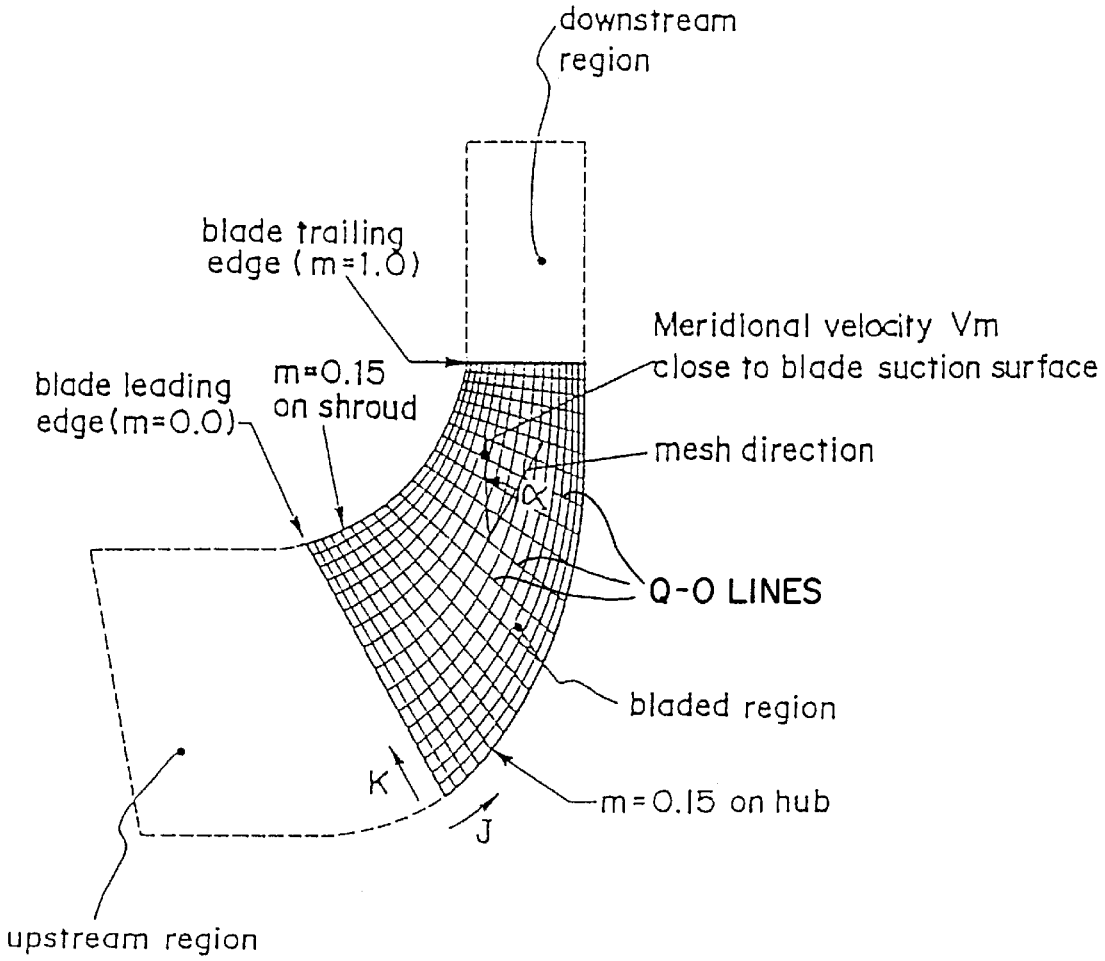
FIG. 1(C) PRIOR ART

FIG. 1(C) is an explanatory view used for the three-dimensional viscous flow calculation and showing the relationship between the computational meshes inside the bladed region and the secondary flow angle α defined in each of the computational meshes. Since the secondary flow is defined as flow which has a velocity component deviating from the direction of the computational mesh, the computational mesh to be used as a basis is required to have a certain regularity. That is, mesh is divided regularly (i.e. mesh division is applied at the same number of mesh points and the same ratio of mesh spacing) between the blade leading edge and the blade trailing edge in J direction on the hub and the shroud surfaces, and meshes of the spanwise direction (K direction) in each J location which connects two corresponding points on the hub surface and the shroud surface are divided regularly, whereby the computational mesh is defined over the entire bladed region. Such computational mesh is generally used in three-dimensional viscous calculations.

MSF-angle used as the quantitative criterion of judgement about suppression of the secondary flow is expressed by the following equation.

$$MSF \rightarrow angle = \left[\int_{0.15}^{1.0}\int_{0.0}^{1.0} \alpha \cdot \rho v_m \cos\alpha \cdot ds \cdot dm\right]_{ss} \Big/ \left[\int_{0.15}^{1.0}\int_{0.0}^{1.0} \rho v_m \cos\alpha \cdot ds \cdot dm\right]_{ss}$$

where

- α is an angle between the tangential direction along the streamwise mesh (J direction) and the direction of the meridional velocity vector at the location near the suction surface of the blade in each computational mesh in the blade region in FIG. 1(C);
- $V_m$ is meridional velocity;
- s is the non-dimensional meridional span length in K direction, s being 0 on the hub surface and 1 on the shroud surface on each Jth Quasi-orthogonal line (mesh line of K direction);
- m is the non-dimensional meridional distance in J direction, m being 0 at the blade leading edge and 1 at the blade trailing edge on each Kth stream surface;
- $[\ ]_{ss}$ is integrated value in the first mesh from the suction surface of the blade.

That is, MSF-angle is defined as mass-averaged value of the magnitude of the flow deviation angle from the streamwise mesh direction over the entire suction surface of the blade.

There is a tendency that when flow which has impinged on the blade at the impeller inlet portion moves around the blade leading edge, a part of flow deviates from the mesh direction. Since this deviation angle has no meaning in the secondary flow caused by viscous action in the boundary layer on the blade surface, in order to eliminate the influence of the above deviating flow, integration is made excluding the region between non-dimensional meridional distance m=0.0 and m=0.15 in which the boundary layer is thin.

In FIG. 7(A), the values of MSF-angle which were calculated by the above equation, the pressure coefficient slope at the shround side CPS-s and the pressure coefficient slope at the hub side CPS-h in verification examples are shown.

On the other hand, the values of MSF-angle in a large amount of verification examples have been calculated by the same manner, and the relationship between the values of MSF-angle calculated in the verification examples and lowering of performance caused by the secondary flow in the verification examples has been studied by the inventors of the present invention. As a result, it was confirmed that as the quantitative criterion of judgement about the suppression of the secondary flow, the selection of the following MSF-angle is appropriate for each of the groups having similar numbers of mesh points and the specific speed.

MSF-angle as the criterion of judgement is 18 degrees in the pump of the specific speed Ns=280.

MSF-angle as the criterion of judgement is 15 degrees in the pump of the specific speed Ns=400.

MSF-angle as the criterion of judgement is 25 degrees in the pump of the specific speed Ns=560.

MSF-angle as the criterion of judgment is 15 degrees in the compressor of the specific speed Ns=488.

By comparing the values of MSF-angle shown in FIG. 7(A) representing the magnitude of secondary flow which is expressed quantitatively in each of verification examples with the confirmed value of MSF-angle for each of the groups as the quantitative criterion of judgment about the action of the secondary flow suppression, the value of MSF-angle in each verification example equal to or larger than the value of MSF-angle as the criterion of judgment means nonadaptation to the above criterion of judgement (insufficient action of secondary flow suppression), and the value of MSF-angle in each verification example smaller than the value of MSF-angle as the criterion of judgment means adaptation to the above criterion of judgment (sufficient action of secondary flow suppression). The data of nonadaptation are shown by solid symbols, and the data of adaptation are shown by open symbols in FIG. 4.

As shown in FIG. 4, a boundary line between data area of solid symbols which show nonadaptation to the criterion and data area of open symbols which show adaptation to the criterion can be drawn on the basis of data plotted in FIG. 4 for each of specific speeds Ns. In the drawing, the three positively sloped straight lines are boundary lines which correspond to the specific speeds Ns=280, Ns=400, and Ns=560, respectively. In each of the specific speeds Ns, the data area located at the lower right side of the boundary line corresponds to the data area of adaptation to the criterion. By further examination of the boundary line, each of data on the boundary line is such that the difference between values of the pressure coefficient slope at the shroud side CPS-s positioned along the vertical axis and values of the pressure coefficient slope at the hub side CPS-h positioned along the horizontal axis is maintained at a constant value. That is, the boundary line concerning the specific speed Ns=280 corresponds to the inclined straight line representing (the value of the pressure coefficient slope at the hub side CPS-h)−(the value of the pressure coefficient slope at the shroud side CPS-s)=0.2/0.4=0.5. Therefore, as shown in FIG. 8, this means that the difference $D_{280}$ between a minimum value ΔCpm of the reduced static pressure difference ΔCp and a value ΔCpm−0.4 of the reduced static pressure difference ΔCp at the location corresponding to non-dimensional meridional distance mm−0.4 obtained by subtracting non-dimensional meridional distance 0.4 from non-dimensional meridional distance mm representing the minimum value ΔCpm is maintained to be 0.20. Therefore, concerning data of the specific speed Ns=280, the data in which the difference $D_{280}$ is not less than 0.2 are plotted by open symbols in the data area of adaptation to the criterion located at the lower right side of the boundary line concerning the specific speed Ns=280. Thus, the impeller in which the difference $D_{280}$ is not less than 0.2 is suitable for suppression of the secondary flow.

The boundary line concerning the specific speed Ns=400 corresponds to the inclined straight line representing (the value of the pressure coefficient slope at the hub side CPS-h)—(the value of the pressure coefficient slope at the shroud side CPS-s)=0.28/0.4=0.7. It can be said that this case is the same tendency as that of the specific speed Ns=280. Therefore, the impeller in which the difference $D_{400}$ is not less than 0.28 is suitable for suppression of the secondary flow.

Further, the boundary line concerning the specific speed Ns=560 corresponds to the inclined straight line representing (the value of the pressure coefficient slope at the hub side CPS-h)−(the value of the pressure coefficient slope at the shroud side CPS-s)=0.35/0.4=0.87. It can be said that this case is also the same tendency as of the specific speed Ns=280. Therefore, the impeller in which the difference $D_{560}$ is not less than 0.35 is suitable for suppression of the secondary flow.

As is apparent from the above description, data area of open symbols which are suitable for suppression of the secondary flow on the plane between the pressure coefficient slope at the shroud side CPS-s and the pressure coefficient slope at the hub side CPS-h means that the difference D between ΔCpm−0.4 at the location of non-dimensional meridional distance mm−0.4 and the minimum value ΔCpm of the reduced static pressure difference ΔCp at the location of non-dimensional meridional distance mm can not be less than a certain value which is dependent on the criterion of judgment about suppression of the secondary flow. The value of the difference D is the result of cooperative contribution of the value of the pressure coefficient slope at the shroud side CPS-s on the vertical axis on the boundary line and the value of the pressure coefficient slope at the hub side CPS-h on the horizontal axis. The degree of contribution of both slopes varies in a wide range; there are three cases, i.e. the first case (1) which is largely dependent on the decreasing tendency of the pressure coefficient slope at the shroud side, the second case (2) which is dependent on the increasing tendency of the pressure coefficient slope at the hub side, and the third case (3) which is dependent on moderate harmonization of the decreasing tendency and the increasing tendency of both slopes. However, it was confirmed by the inventors of the present invention that as shown in FIG. 8, there exists a lower limit of the pressure coefficient slope at the shroud side $CPS\text{-}s_{,LIM}$ having a lower limit of negative value in the aft part from the location of non-dimensional meridional distance mm−0.4 to the impeller exit (m=1.0), and in the case where the formation of the difference D is dependent largely on the value of the pressure coefficient slope at the shroud side CPS-s less than the lower limit of the pressure coefficient slope at the shroud side CPS-$s_{,LIM}$, the flow separation occurs in the aft part from the location of non-dimensional meridional distance mm−0.4 to the impeller exit (m=1.0), generating significant reduction in head and efficiency.

Figure 23:
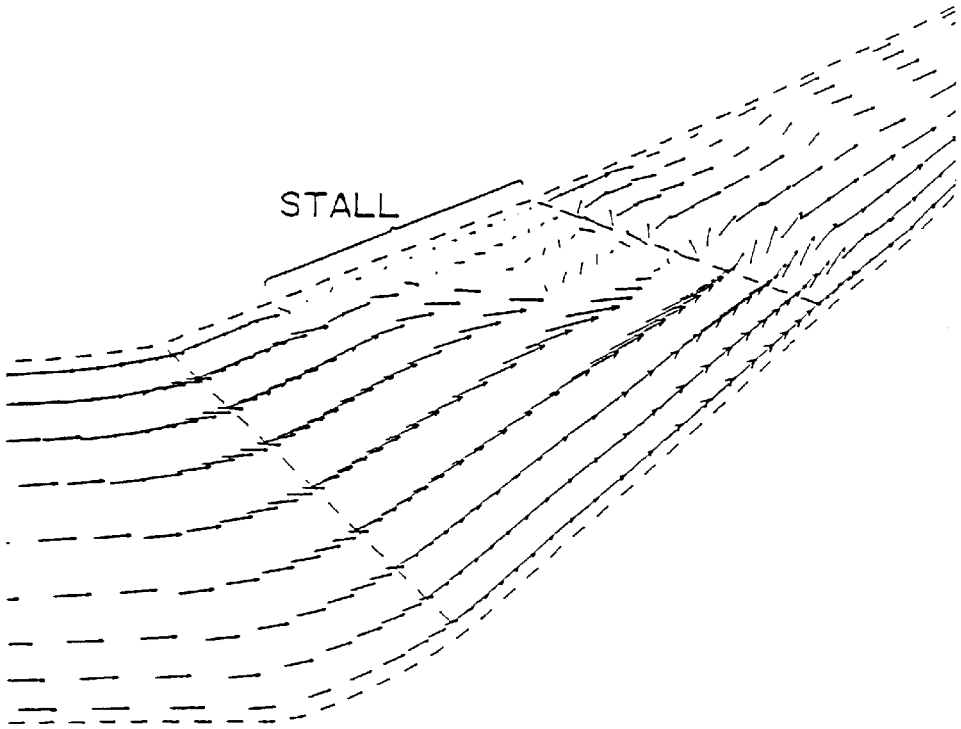
FIG. 23 is a flow vector diagram showing the state of flow separation in the verification example "O"
Figure 24:
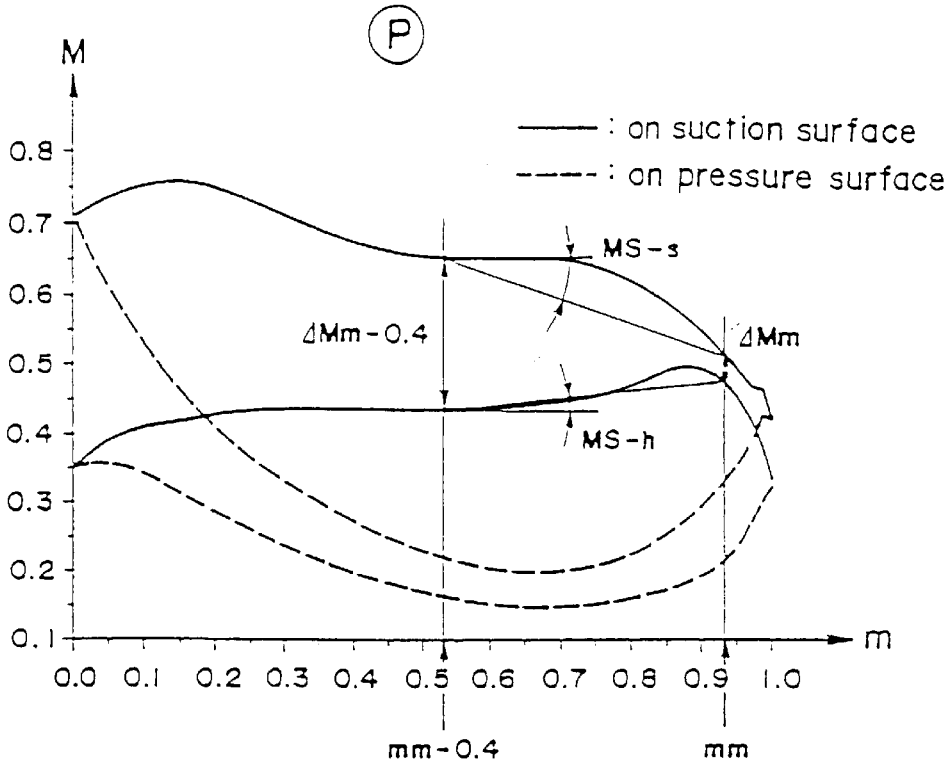
FIG. 24 through FIG. 29 are characteristic graphs showing the distribution of the Mach number along non-dimensional meridional distance m of the blade.

The lower limit of the pressure coefficient slope at the shroud side CPS-$s_{,LIM}$ thus confirmed is −1.3, and this is proved by the fact that the horizontal straight line, which defines data area generating flow separation and including three verification examples 5, 6, and O at the lower side of the line, can be drawn. As an example, FIG. 23 is a flow vector diagram showing the state of flow separation in the verification example of O.

It was confirmed by the inventors of the present invention that the flow separation emerges in the aft part from the location of non-dimensional meridional distance mm−0.4 to the impeller exit (m=1.0) when CPS-s is less than the lower limit of CPS-$s_{,LIM}$, but there exists another lower limit in the fore part of the blade toward the impeller inlet (m=0) difference from the lower limit of the pressure coefficient slope at the shroud side CPS-$s_{,LIM}$ in the aft part from the location of non-dimensional meridional distance mm−0.4. In order to prevent flow separation caused by the steep pressure coefficient slope at the shroud side in the fore part of the location toward the impeller inlet (m=0), the location of non-dimensional meridional distance mm at which the minimum value ΔCpm of the reduced static pressure difference ΔCp emerges is preferably selected to be in the range of non-dimensional meridional distance m=0.8−1.0, i.e. in the aft part toward the impeller exit (m=1.0).

Further, in the lower part of FIG. 7(A), concerning compressor of a specific speed Ns=488, the values of Mach number slope at the shroud side MS-s, the values of Mach number slope at the hub side MS-h and the values of MSF-angle are shown for eight examples of P, 9, Q, R, S, T, U and 10. The data of verification examples were plotted on the plane of FIG. 5 corresponding to that of FIG. 4 in the same manner as FIG. 4.

As described above, in compressors which handle compressible fluid, it is known that the pressure coefficient slope at the shroud side CPS-s and the pressure coefficient slope at the hub side CPS-h correspond to the Mach number slope at the shroud side MS-s and the Mach number slope at the hub side MS-h, respectively. The plane in FIG. 5 is defined by a vertical axis representing the Mach number slope at the shroud side MS-s and a horizontal line representing the Mach number slope at the hub side MS-h.

Figure 5:
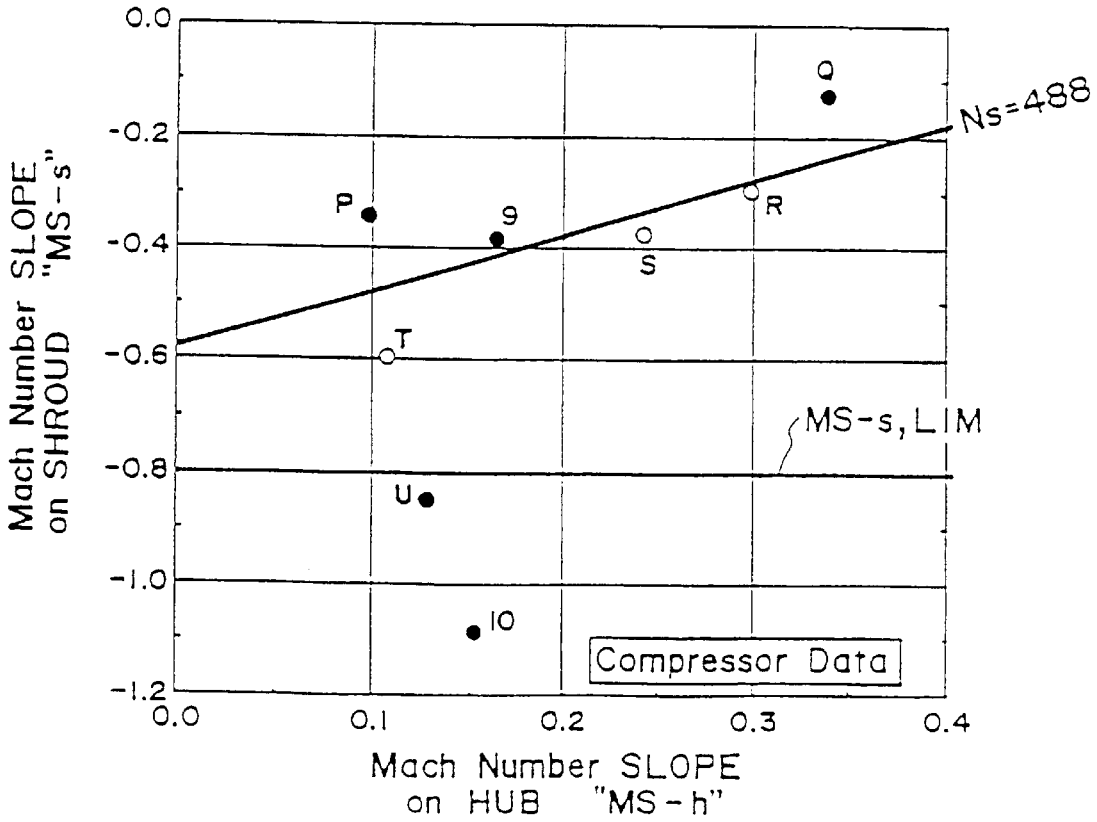
FIG. 5 is a graph showing verification data plotted on the plane defined by a vertical axis representing the Mach number slope at the shroud side MS-s and a horizontal axis representing the Mach number slope at the hub side MS-h, and further showing boundary lines defined by specific speeds Ns and the lower limit of the Mach number slope at the shroud side MS-$s_{,LIM}$.

From a large amount of verification data including principal verification examples plotted on the plane of FIG. 5, as a boundary line concerning a compressor of a specific speed Ns=488, an inclined straight line representing (the value of the Mach number slope at the hub side MS-h)−(the value of the Mach number slope at the shroud side MS-s)=(0.23/0.4)=0.575 can be drawn, and data area located at the lower right side of the boundary line corresponds to data area of adaptation to the criterion of judgment about suppression of the secondary flow.

This means that in the compressor of a specific speed Ns=488, the difference $MD_{488}$ between a minimum value ΔMm of the reduced static pressure difference ΔM and a value ΔMm−0.4 of the reduced static pressure difference ΔM at the location corresponding to non-dimensional meridional distance mm−0.4 obtained by subtracting non-dimensional meridional distance 0.4 from non-dimensional meridional distance mm representing the minimum value ΔMm is maintained to be 0.23. Therefore, it was confirmed from a large amount of verification examples that the impeller in which the difference $MD_{488}$ is not less than 0.23 and which corresponds to data area shown by open symbols is suitable for suppression of the secondary flow.

However, it was confirmed by the inventors of the present invention that there exists a lower limit of the Mach number slope at the shroud side MS-$s_{,LIM}$ and in the case where the value of the Mach number slope at the shroud side MS-s is less than the lower limit of the Mach number slope at the shroud side MS-$s_{,LIM}$, the flow separation is generated in the aft part from the location of non-dimensional meridional distance mm−0.4 to the impeller exit (m=1.0), generating significant reduction in head and efficiency.

Figure 30:
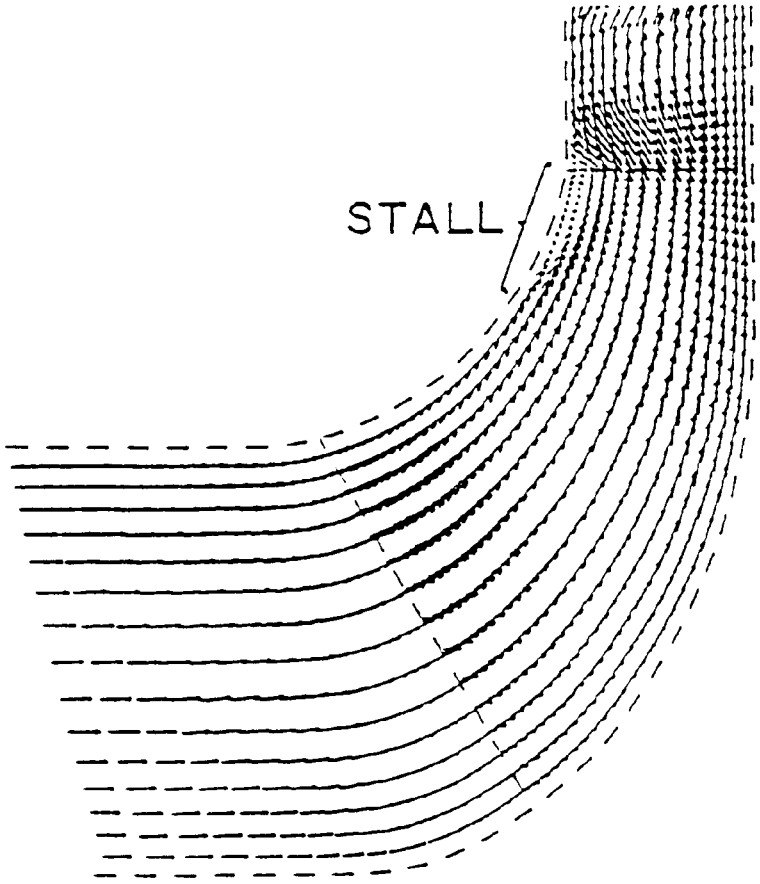
FIG. 30 is a flow vector diagram showing the state of flow separation in the verification example "U".

The lower limit of the pressure coefficient slope at the shroud side CPS-$s_{,LIM}$ thus confirmed is −0.8 in the compressor of the specific speed Ns=488, and this is proved by the fact that the horizontal straight line, which defines data area generating flow separation and including two verification examples, U and 10 at the lower side of the line, can be drawn. As an example, FIG. 30 is a flow vector diagram showing the state of flow separation in the verification example of U.

It was confirmed by the inventors of the present invention that the flow separation emerges in the aft part from the location of non-dimensional meridional distance mm−0.4 to the impeller exit (m=1.0) when MS-s is lower than the lower limit of MS-$s_{,LIM}$, but there exists another lower limit in the fore part of the blade toward the impeller inlet (m=0) difference from the lower limit of the Mach number slope at the shroud side MS-$s_{,LIM}$ in the aft part from the location of non-dimensional meridional distance mm−0.4. In order to present flow separation caused by the steep Mach number slope at the shroud side in the fore part of the location toward the impeller inlet (m=0), the location of non-dimensional meridional distance mm at which the minimum value ΔCpm of the reduced static pressure difference ΔCp emerges is preferably selected to be in the range of non-dimensional meridional distance m=0.8−1.0, i.e. in the aft part toward the impeller exit (m=1.0).

Figure 25:
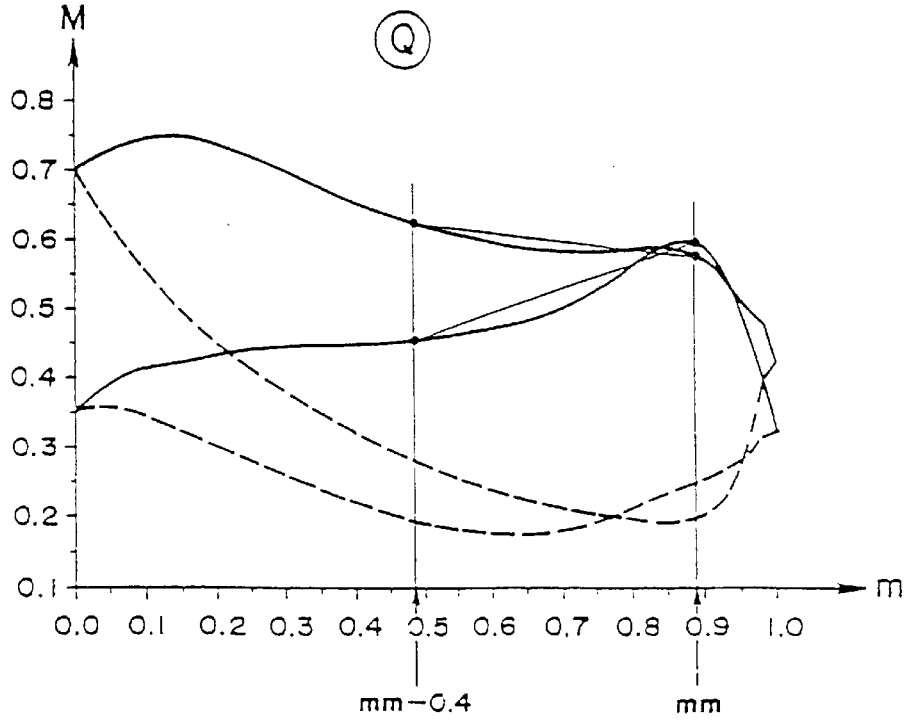
Figure 26:
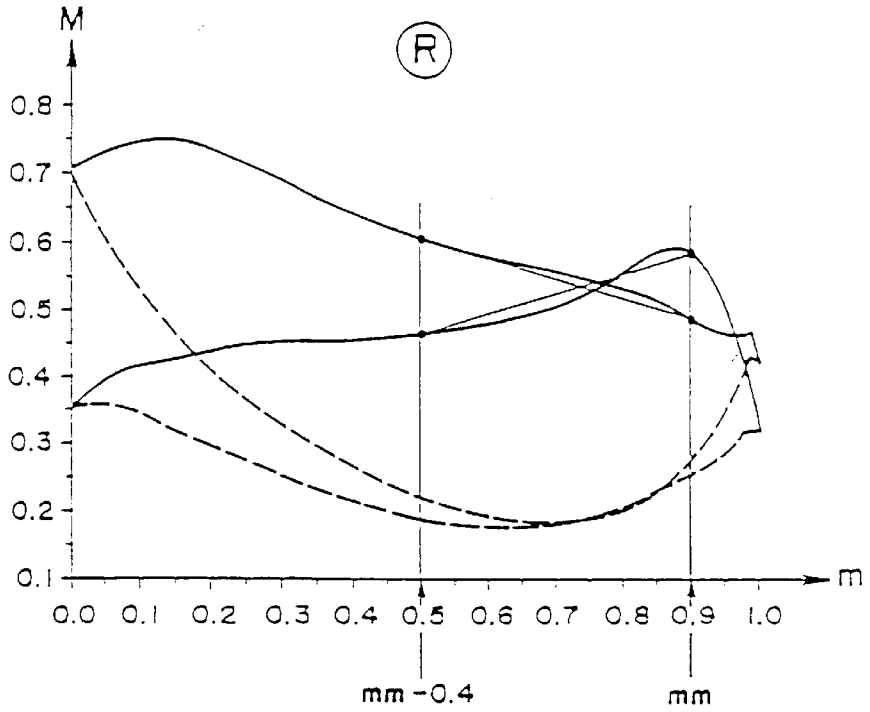
Figure 27:
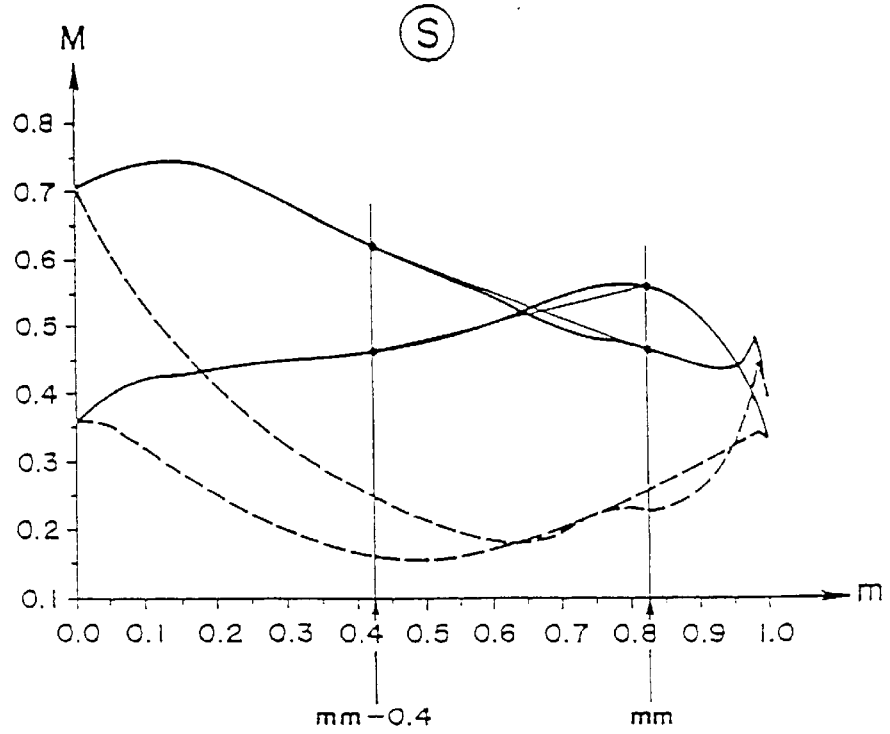
Figure 28:
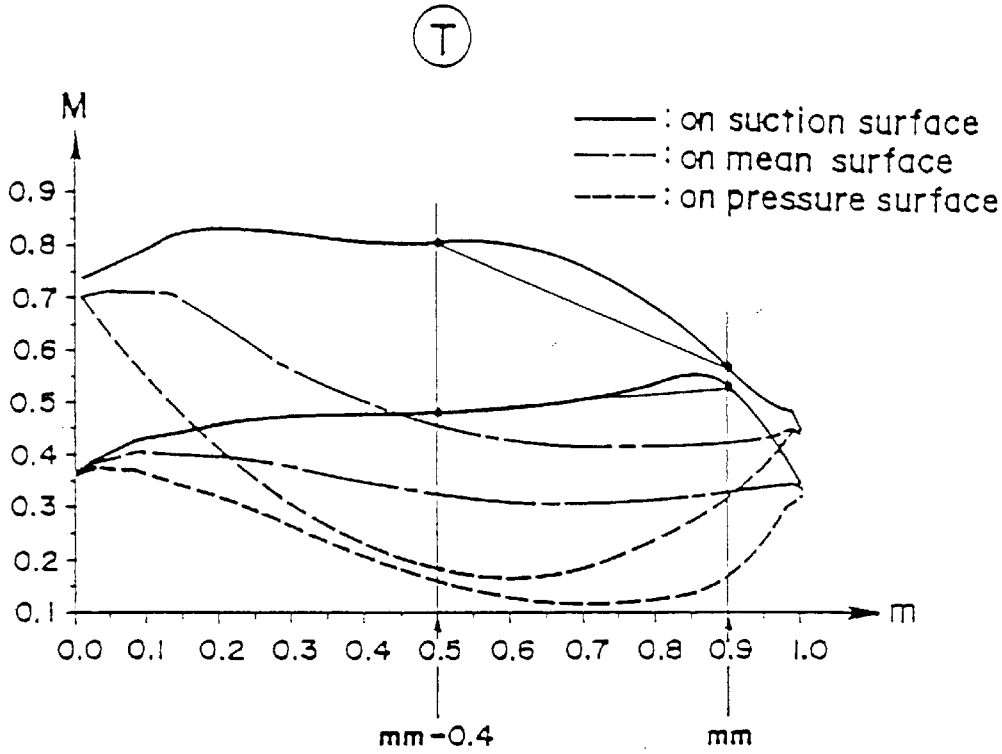
Figure 29:
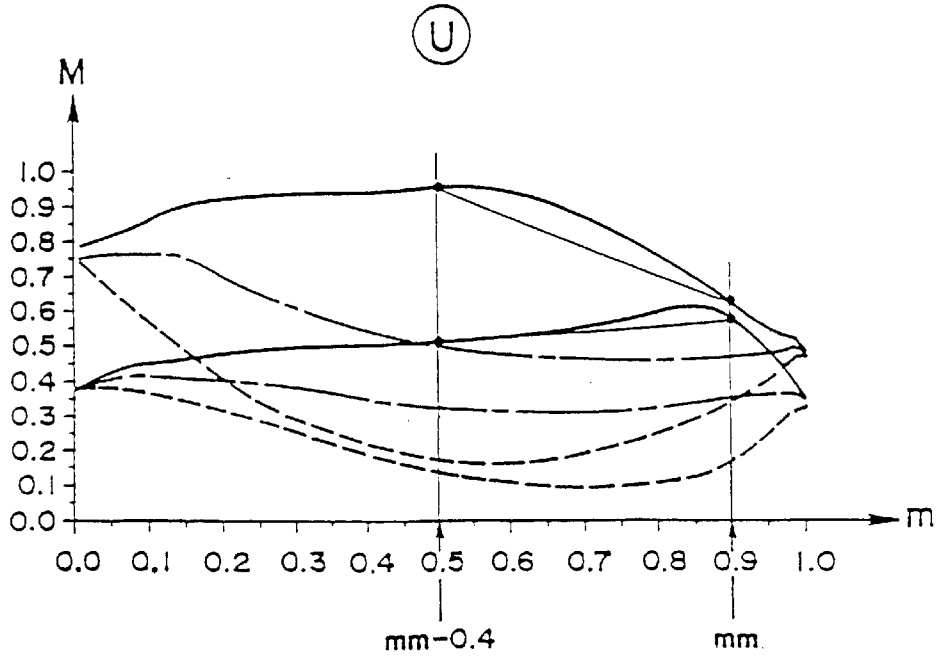

Referring back to FIG. 7(A), in the lower part of FIG. 7(A), concerning compressor of a specific speed Ns=488, values of the Mach number slope at the shroud side MS-s and the Mach number slope at the hub side MS-h, as can be referenced in FIG. 25, were read from the Mach number curves of the verification examples shown in FIGS. 24 through 29 in the order of P, Q, R, S, T and U, and shown. In each of the verification examples, the calculation process of MSF-angle, the criterion of judgment by MSF-angle and the evaluation process for evaluating the secondary flow suppression quantitatively are the same as the description related to FIG. 4, thus further explanation may be omitted.

In the present invention, the verification examples in FIG. 4 for pumps are presented in the range of the specific speed Ns=280–560. According to the concept of the present invention, there will be another optimum value for the range of the specific speed of not more than Ns=280. However, as is observed from the tendency of the inclined boundary lines in FIG. 4, the $D_{280}$ value is lower than $D_{400}$ and $D_{560}$ value, and $D_{400}$ value is lower than $D_{560}$ value. So, the critical value of D has a tendency to have a lower value for an impeller having a lower specific speed, although the quantitative dependency on the specific speed is not clear in FIG. 4 (the quantitative dependency is clarified in the following second aspect of the present invention). Therefore, the impeller, having suppressed meridional secondary flow, can be designed in safety by using D value of not less than $D_{280}$=0.2 for the specific speed range of not more than Ns=280. Similarly, the impellers, having suppressed meridional secondary flows, for the specific speed range of not more than Ns=400 and Ns=560 can be designed in safety by using D value of not less than $D_{400}$=0.28 and $D_{560}$=0.35, respectively.

In the compressor, only the data of the specific speed of Ns=488 are presented in FIG. 5. However, the flow mechanism leading to the suppression of the meridional secondary flows is the same between pumps and compressors, and so that compressor impellers, having suppressed meridional secondary flow, for the specific speed range of not more than Ns=488 can be designed in safety by using DM value of not less than $DM_{488}$=0.23.

Next, an embodiment according to the second aspect of the present invention will be described below.

According to the embodiment of the first aspect of the present invention, the boundary lines of the inclined straight lines are confirmed and drawn in FIG. 4 or FIG. 5 dispersively for each of the specific speeds of the turbomachinery or sorts of fluid (incompressible fluid or compressible fluid), and the dependence of data on the specific speed is not made evident quantitatively. Therefore, concerning the turbomachinery having a certain specific speed and handling a certain kind of fluid, when designing suitably the contribution in the pressure coefficient slope at the shroud side CPS-s and the pressure coefficient slope at the hub side CPS-h or the Mach number slope at the shroud side MS-s and the Mach number slope at the hub side MS-h from the aspect of secondary flow suppression so that the difference D between a minimum value ΔCpm of the reduced static pressure difference ΔCp and the value ΔCpm−0.4 of the reduced static pressure difference ΔCp at the location corresponding to non-dimensional meridional distance mm−0.4 obtained by subtracting non-dimensional meridional distance 0.4 from non-dimensional meridional distance mm representing the minimum value ΔCpm or the difference DM between the minimum value ΔMm of the relative Mach number difference ΔM and a value ΔMm−0.4 of the relative Mach number difference ΔM at the location corresponding to non-dimensional meridional distance obtained by subtracting non-dimensional meridional distance 0.4 from non-dimensional meridional distance representing the minimum value amounts to a certain value or more, there are cases to which the boundary lines shown on the plane of FIG. 4 or FIG. 5 are not directly applicable.

Therefore, according to the second aspect of the present invention, with respect to the difference D between a minimum value ΔCpm of the reduced static pressure difference ΔCp and a value ΔCpm−0.4 of the reduced static pressure difference ΔCp or the difference DM between a minimum value ΔMm of the relative Mach number difference ΔM and a value ΔMm−0.4 of the relative Mach number difference ΔM, the dependence on the specific speed is clarified in spite of the types of fluid. That is, concerning the difference D or DM, the pressure coefficient Cp* which is normalized by the pressure coefficient Cp, mid-mid in the center of fluid passage is introduced and newly defined, whereby the boundary line according to the first aspect of the present invention can be expressed as a function of the specific speed Ns.

Figure 6:
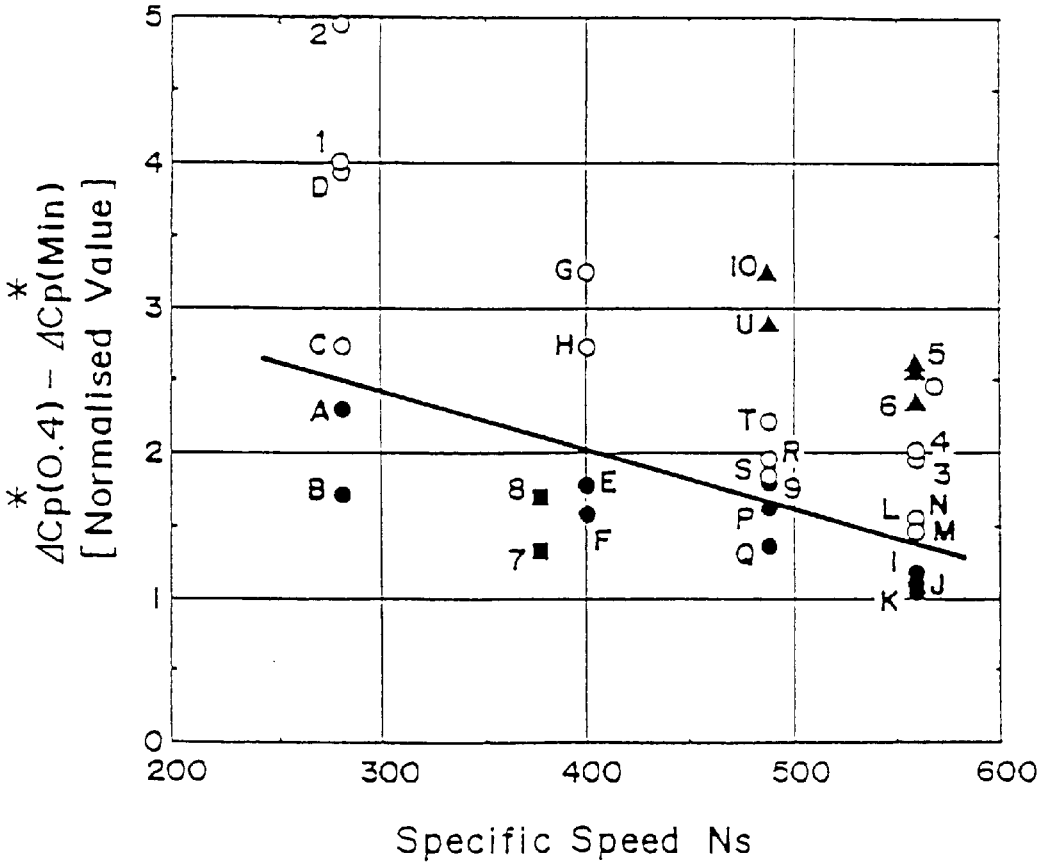
FIG. 6 is a graph showing verification data plotted on the plane defined by a vertical axis representing the difference D* between a minimum value ΔCp*m of the normalized reduced static pressure difference ΔCp* and a value $\Delta Cp^*_{m-0.4}$ of the normalized reduced static pressure difference ΔCp* at the location corresponding to non-dimensional meridional distance mm−0.4 obtained by subtracting non-dimensional meridional distance 0.4 from non-dimensional meridional distance mm representing the above minimum value ΔCp*m and a horizontal axis representing a specific speed Ns, and further showing boundary lines defined by specific speeds Ns, thereby expressing the above difference D* as a function of the specific speeds Ns.

FIG. 6 shows the plotted data about the above difference on the basis of the normalized pressure difference Cp* in verification examples. In FIG. 6, the vertical axis represents the difference D* between the normalized reduced static pressure difference ΔCp*m−0.4 at the location of non-dimensional meridional distance mm−0.4 and a minimum value ΔCp*m the normalized reduced static pressure difference ΔCp* at the location of non-dimensional meridional distance mm, and the horizontal axis represents a specific need Ns of the turbomachinery. Data plotted on the plane defined by both axes are the same as the data plotted on the plane of FIGS. 4 and 5. A boundary line of negatively sloped straight line can be drawn so that data shown by open symbols representing adaptation to the quantitative criterion of judgement about suppression of the secondary flow are located on the data area at the upper right of the drawing, and data shown by solid symbols representing nonadaptation to the quantitative criterion of judgement about suppression of the secondary flow are located on the data area at the lower left of the drawing.

Figure 1D:
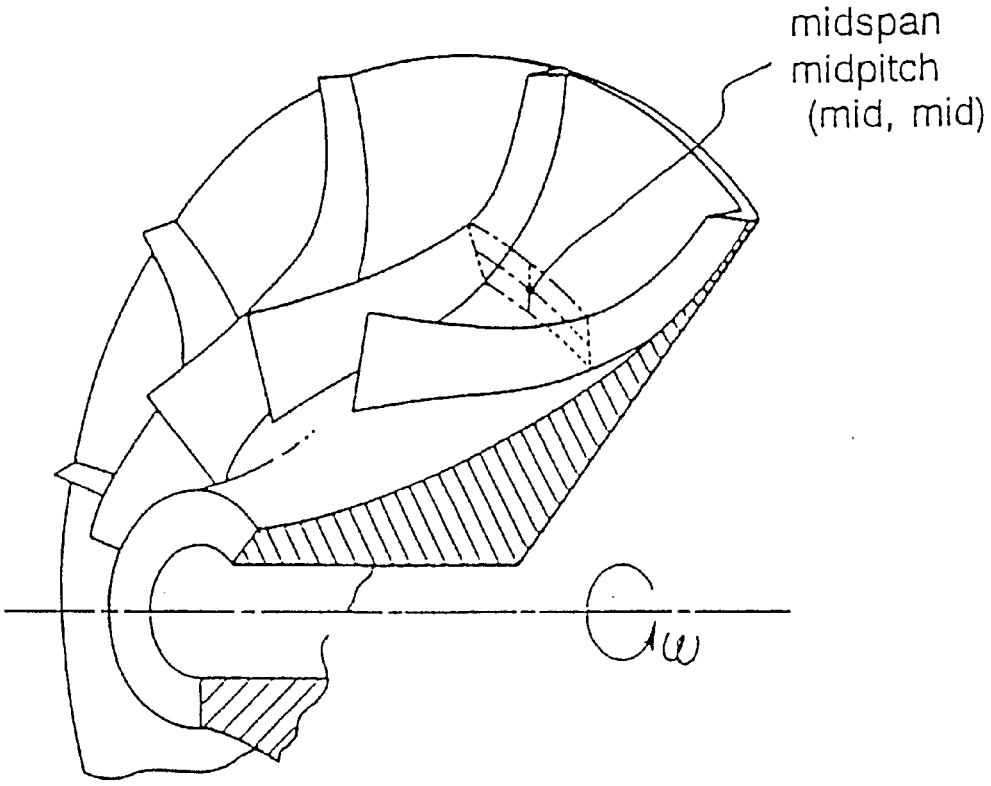
FIG. 1(D) PRIOR ART

By reading the gradient of the boundary line, and the intersection of the boundary line and the vertical axis, as a function which is dependent on the specific speed Ns and represents the difference D* of the normalized reduced static pressure difference, the appropriateness of the following equation was confirmed.

$$D^*=\Delta Cp^*m-0.4-\Delta Cp^*m=-0.004\,Ns+3.62$$

where the normalized pressure coefficient is defined in the following equation.

$$Cp^*=Cp/Cp,\ mid\text{-}mid$$

where Cp, mid-mid is a pressure coefficient in the center of the flow channel as shown in FIG. 1(D).

In compressors which handle compressive fluid, the relative Mach number M can be related to the pressure coefficient Cp by the following equation, thus the normalized pressure coefficient Cp* is applicable to every kinds of fluid.

$$Cp=2[1-(1-0.5W^2/H_0^*)^{\gamma/(\gamma-1)}]/\gamma M_0^{*2}$$

$$M_0^*=Ut/(\gamma P_0^*/\rho_0^*)^{0.5}$$

where Ut is a peripheral speed of the impeller, W is a relative velocity, $H_0^*$ is a rothalpy, γ is a ratio of specific heats, $P_0^*$ is a rotary stagnation pressure, and $\rho_0^*$ is a density corresponding to $P_0^*$.

In verification examples, the differences (D*=ΔCp*m−0.4−ΔCp*m) of the reduced static pressure differences, which are the basis of the values of the data plotted on the plain of FIG. 6, are shown in a table of FIG. 7(B).

Incidentally, verification examples 7 and 8 are related to the pumps of a specific speed Ns=377. It was confirmed that the data of the above verification examples are defined by the boundary line on the plane of FIG. 6, and located on the data area of nonadaptation to suppression of the secondary flow. Incidentally, it is confirmed by the three-dimensional viscous calculations that the value of pressure coefficient slope at the shroud side which is negative and extremely small (steep), compared with the lower limit of the pressure coefficient slope at the shroud side $CPS\text{-}s_{,LIM}$, emerges in the fore part toward the impeller inlet (m=0) from the location of non-dimensional meridional distance m−0.4, therefore flow separation is generated in the fore part of the impeller. Therefore, the information on the secondary flow development in the verification data of 7 and 8 could not be ascertained.

An embodiment according to the third and fourth aspects of the present invention will be described below. When designing and manufacturing a turbomachinery having an impeller with a three-dimensional shape for realizing the remarkably decreasing tendency in the reduced static pressure difference ΔCp or the relative Mach number difference ΔM characterized by the first aspect of the present invention along the location of non-dimensional meridional distance m toward the impeller exit in the third aspect of the present invention, and when designing and manufacturing a turbomachinery having an impeller with a three-dimensional shape for realizing the remarkably decreasing tendency in the reduced static pressure difference $\Delta Cp^*$ characterized by the second aspect of the present invention on the basis of the normalized pressure coefficient $Cp^*$, the following design method for the three-dimensional geometry of the impeller is utilized. The design method comprises a first step of determining the meridional geometry, a second step of determining the blade loading distribution, a third step of determining blade profile, a fourth step of judging the optimum reduced static pressure difference $\Delta Cp$ and the like, and a fifth step of evaluating flow fields.

In these aspects, while selecting properly by trial and error the blade loading distribution on the basis of the known close relationship between the pressure coefficient Cp and the angular momentum $r\overline{V}_\theta$, the pressure coefficient Cp is increased or decreased. And, by utilizing the following three-dimensional inverse design method using the $r\overline{V}_\theta$ distribution as an input data, the three-dimensional shape of the impeller which realizes a characteristic distribution characterized by the first and second aspects of the present invention is determined.

Figure 3A:
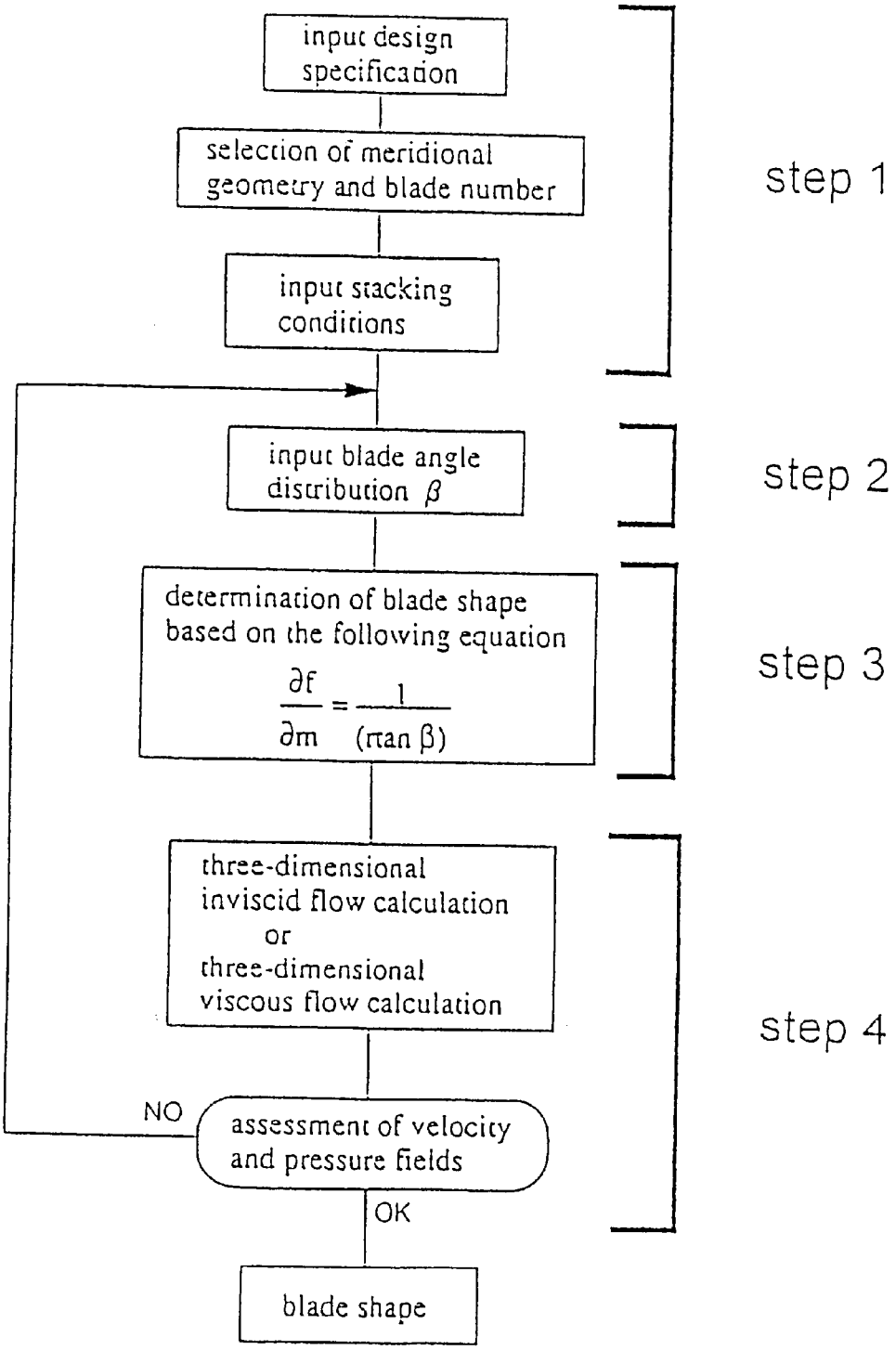
FIG. 3(A) PRIOR ART
FIGS. 3(A) and 3(B) are flow charts of numerical analysis by a computer to determine a three-dimensional shape of the impeller in the turbomachinery.
Figure 3B:
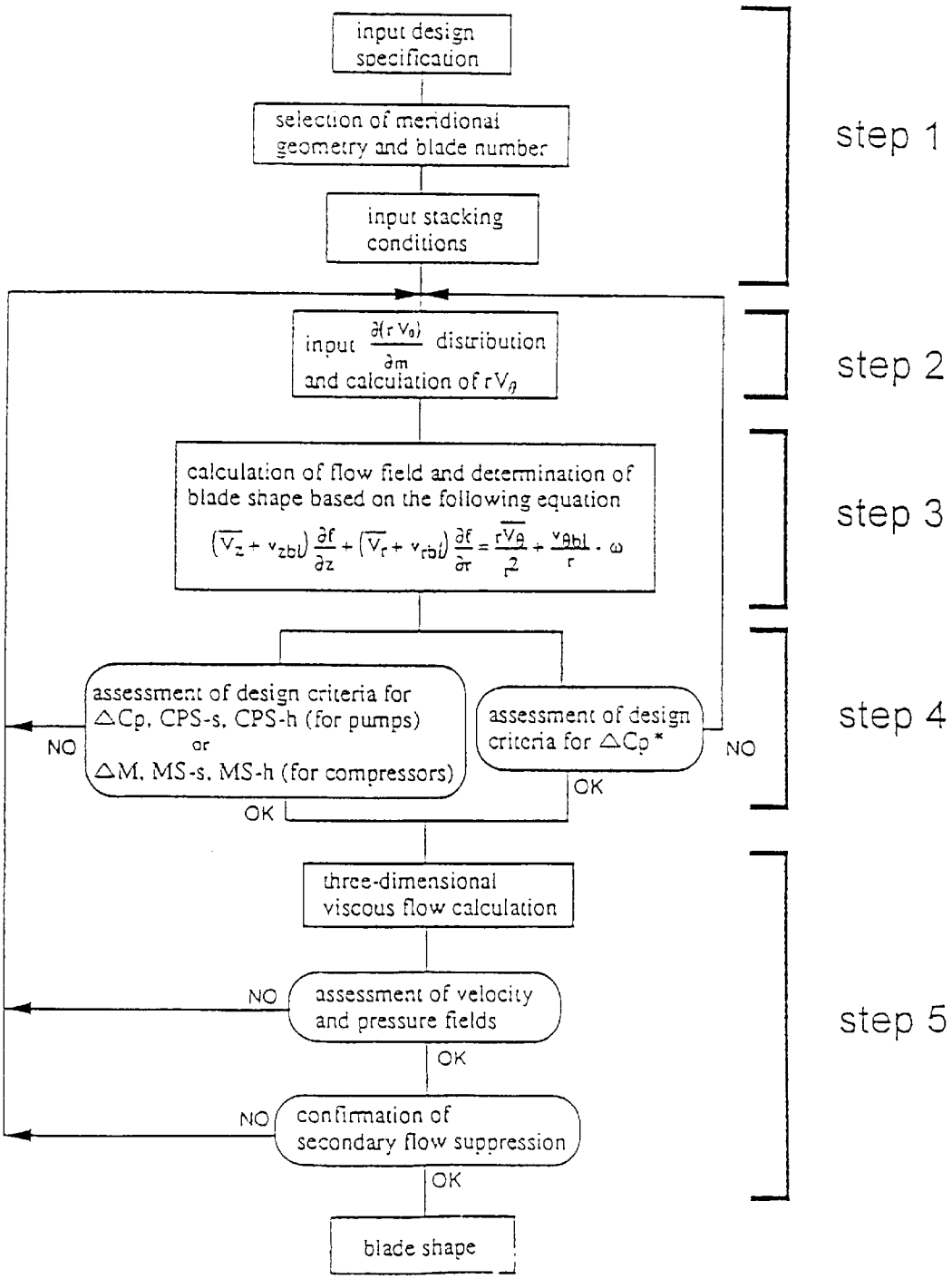

In this case, the design method is processed by the flow chart shown in FIG. 3(B).

In the first step (step of determining meridional geometry), based on the conventional knowledge about the correlation with the specific speed Ns calculated from the design specification, the meridional shape of the hub and the shroud and the position of the leading edge of the blade and the trailing edge of the blade are defined, and the number of blades of the impeller is selected. Mesh required for numerical calculation is formed at equal intervals or unequal intervals along the hub and the shroud surfaces. This mesh is extended to upstream of the leading edge of the blade and downstream of the trailing edge of the blade. The mesh is similar to that in FIG. 1(C) of the mesh for viscous flow calculations. Quasi-Orthogonal lines (Q-O line) are drawn by connecting the corresponding points on the hub and the shroud. Next, a plurality of surfaces of revolution is defined in the meridional flow channel, and the stacking condition $f_0$ (tangential co-ordinate of the blade camber line at a point on each of surfaces of revolution). The process in the first step is essentially the same as the process in the first step of the conventional design method shown in FIG. 3(A).

In the second step (step of determining blade loading distribution), the shape of the blade loading distribution $\partial(r\overline{V}_\theta)/\partial m$ is selected so that the blade loading distribution has a peak on the shroud surface in the first half of the non-dimensional meridional distance m along the shroud and a peak on the hub surface in the latter half of the non-dimensional meridional distance m along the hub. Next, the distribution of $\partial(r\overline{V}_\theta)/\partial m$ along the hub and shroud is integrated along the non-dimensional meridional distance m to determine $r\overline{V}_\theta$ distribution. The resultant values on the hub and the shroud surfaces obtained by integration along the non-dimensional meridional distance m are adjusted to satisfy the exit velocity triangles (i.e. the $\overline{V}_\theta$ values on the hub and the shroud at the impeller exit determined, in manner similar to the conventional method, from the design head of the impeller), and the $r\overline{V}_\theta$ distribution between the hub and the shroud is determined by the linear interpolation along Q-O line determined by the first step.

In the third step (step of determining blade profile), the blade camber line is obtained by applying the condition that the velocity is along the blade at the blade camber line, i.e. there is no flow through the blade camber.

Figure 1E:
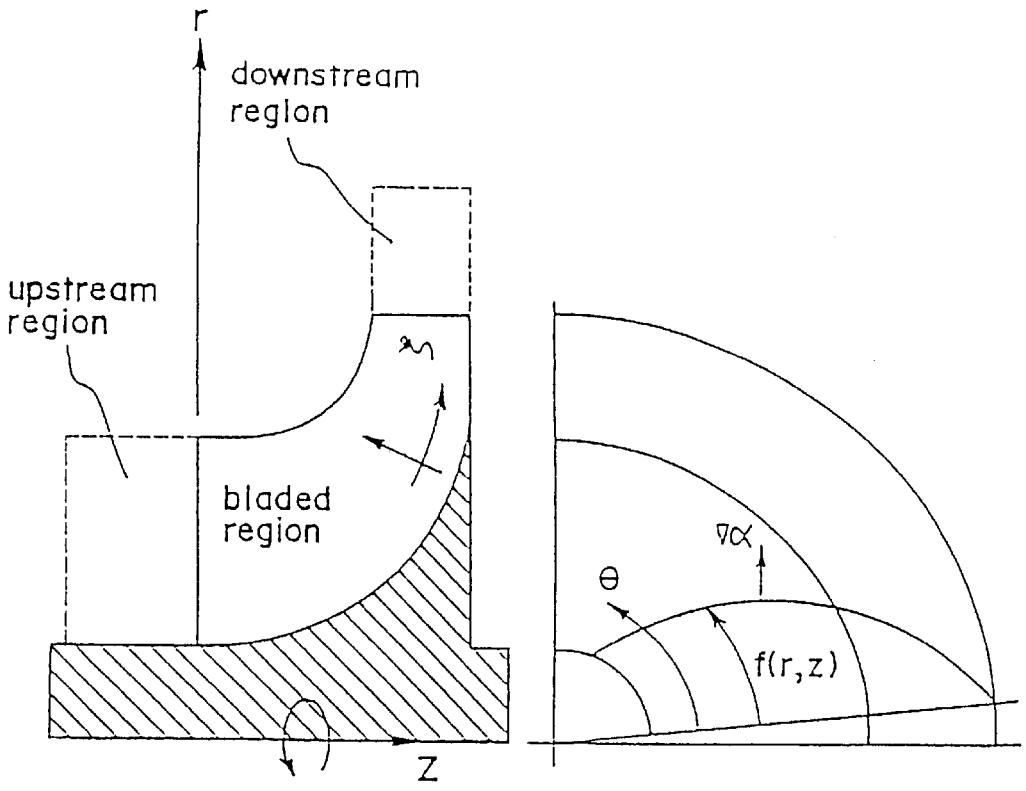
FIG. 1(E) PRIOR ART
Figure 2A:
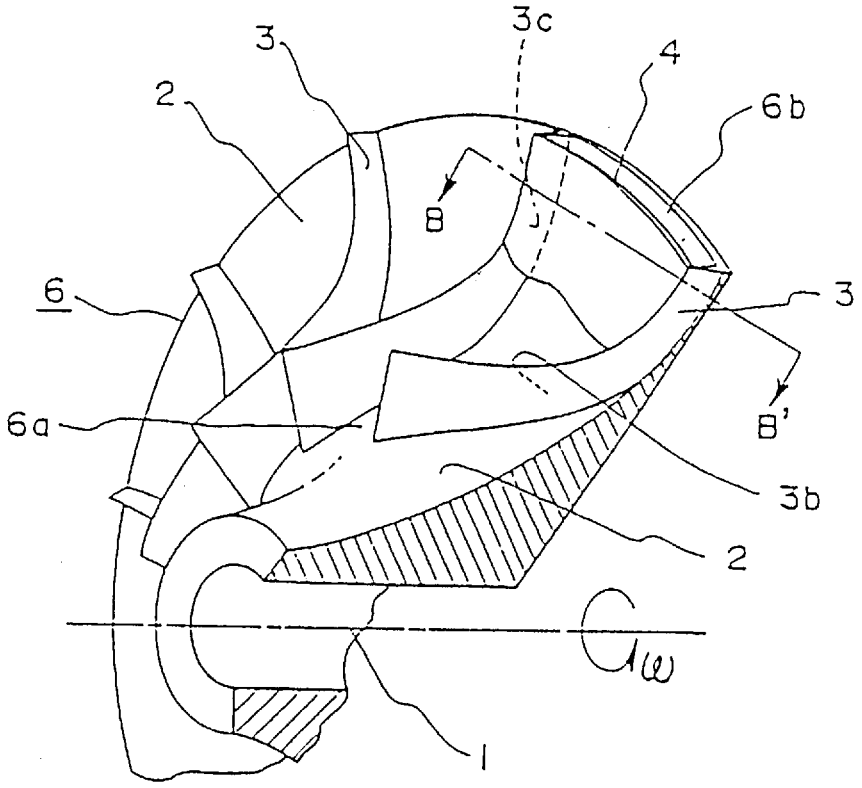
FIG. 2(A) PRIOR ART
Figure 2B:
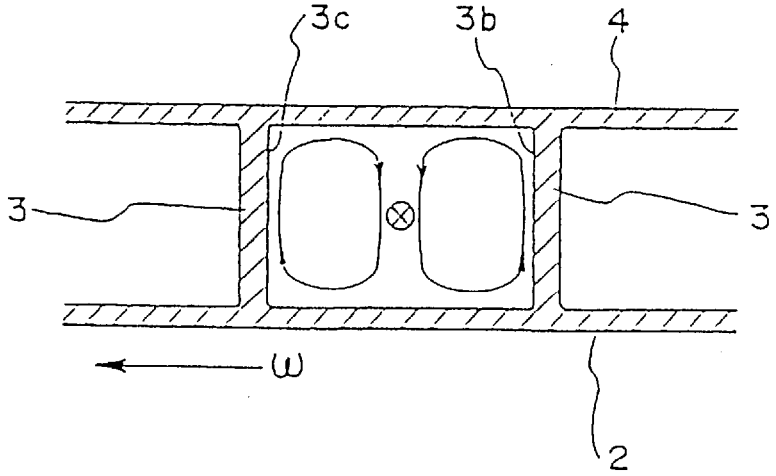
FIG. 2(B) PRIOR ART

If we represent the location of the blade camber line $\alpha$, which is defined as:

$$\alpha=\theta-f(r, z)=0,\ n2\pi/B,\ (n=1, 2, 3 \ldots B)$$

where f is the tangential co-ordinate of the blade camber line (or wrap angle), $\theta$ is the tangential co-ordinate of cylindrical polar co-ordinate system, and B is the number of blades (as shown in FIG. 1(E)).

The above condition is expressed mathematically in the following equation.

$$W-\cdot\nabla(\alpha)=0,\ W-\cdot\nabla(\alpha)=0$$

where W· and W− are the relative velocities of the pressure and the suction surfaces of the blade, respectively, $\nabla$ is vector calculus operator.

The above two equations are combined to give the following equation.

$$W_{b1}\cdot\nabla\alpha=0 \text{ where } W_{b1}=(W\cdot+W-)/2$$

The above equation can be decomposed into its components and expressed in the following equation.

$$\{(\overline{V}z+v_{zb1})\partial f/\partial z\}+\{(\overline{V}r+v_{rb1})\partial f/\partial r\}=\{(r\overline{V}_\theta)/r^2\}+\{(v_{\theta b1})/r\}-\omega$$

The above equation is a first order hyperbolic partial differential equation. The value of $f_0$ along an arbitrary Q-O line in the blade (the stacking condition) is used as an initial value, and the above equation is integrated along the non-dimensional meridional distance m, and the tangential co-ordinate of the blade camber line f in the location of non-dimensional meridional distance m is determined. And, the three-dimensional geometry of the impeller is determined by adding a certain thickness to the determined blade camber line to allow the blade to have required mechanical strength. The stacking condition can be specified by, for example, setting the zero value of $f_0$ along the Q-O line at the blade trailing edge, or setting a moderate distribution of $f_0$ value along the Q-O line at the blade trailing edge.

The calculation of the relative velocity W, in the above mentioned equations, is processed in the following manner.

The velocity field is split into tangentially-averaged and tangentially periodic components. To determine the tangentially-averaged flow the radial and axial velocities ($\overline{V}r$ and $\overline{V}z$, respectively) are expressed in terms of a stream function in order to satisfy the continuity (or mass conservation) equation of fluid dynamics. Then a Poisson type partial differential equation governing the stream function is obtained by using a suitable equation for the vorticity field generated by the action of the blades, which in turn is related to the blade circulation $2\pi r\overline{V}_\theta$. This equation can then be integrated by any suitable numerical method subject to uniform velocity conditions at upstream and downstream boundaries and no flow (or constant stream function) conditions at the hub and shroud walls. Integration of this equation will give the values of stream function from which $\overline{V}r$ and $\overline{V}z$ are obtained.

The velocity terms $v_{rb1}$, $v_{zb1}$ and $v_{\theta b1}$ are obtained from the solution of the tangentially periodic flow. For the solution of the periodic flow the Clebsch formulation of the velocity field is used. In this formulation the velocity field is split into an unknown irrotational part (represented by a velocity potential function) and a known rotational part which is related to the blade circulation $2\pi r\overline{V}_\theta$. The governing equation of the unknown potential function is then found by using the Clebsch formulation for the velocity field in the continuity equation of the periodic flow. In this way a 3D Poisson's equation is obtained which can then be integrated by a suitable numerical technique, subject to vanishing periodic tangential velocity and spanwise velocity at upstream and downstream boundaries and no-flow conditions through the hub and shroud surface.

According to the above method, velocity field as well as blade loading of the impeller, i.e. the pressure difference p(+)−p(−) between the pressure p(+) on the pressure surface and the pressure p(−) on the suction surface of the blade can be obtained in the following equation.

$$\{p(+)-p(-)\}/\rho=2\pi(W_{b1}\cdot\nabla r\bar{V}_\theta)/B,$$

where $W_{b1}$ is relative velocity at the location on blade surface.

In this way, the reduced static pressure difference ΔCp or the relative Mach number difference ΔM between the hub and the shroud on the suction surface of the blade can be obtained.

Further, the value which is not dependent on the specific speed and the type of the impeller, i.e. both for a compressor which handles compressible fluid and a pump which handles incompressible fluid, the normalized pressure coefficient Cp* is defined as follows.

$$Cp^*=Cp/Cp,mid\text{-}mid$$

where Cp,mid-mid is the pressure coefficient at the center of the flow channel (midspan and midpitch) at the location of non-dimensional meridional distance m. The pressure coefficient Cp in compressible fluid is defined in the following equation.

$$Cp^*=2[1-(1-0.5W^2/H_0^*)^{\gamma/(\gamma-1)}]/\gamma M_0^{*2}$$

$$M_0^{*2}=Ut/(\gamma P_0^*/\rho_0^*)^{0.5}$$

where Ut is a peripheral speed of the impeller, W is a relative velocity, $H_0^*$ is a rothalpy, γ is a ratio of specific heats, $P_0^*$ is a rotary stagnation pressure, and $\rho_0^*$ is a density corresponding to $P_0^*$.

In the fourth step (a step of judging optimum reduced static pressure difference ΔCp and the like), it is judged whether or not the distribution of the reduced static pressure difference ΔCp or the relative Mach number difference ΔM along the location of non-dimensional meridional distance m calculated in the third step is suitable for suppression of the secondary flow in the impeller. When establishing the distribution of reduced static pressure difference ΔCp for realizing suppression of the secondary flow, the decreasing tendency in the reduced static pressure difference ΔCp is realized by (a) the degree of dependence on a variation at the shroud side, (b) the degree of dependence on a variation at the hub side, and (c) the degree of dependence on both variation at the shroud side and the hub side. In order to judge the suitable ΔCp distribution numerically, the pressure coefficient slope on the suction surface of the blade at the shroud side CPS-s and the pressure coefficient slope on the suction surface of the blade at the hub side CPS-h between the location of a minimum value ΔCpm of the reduced static pressure difference ΔCp and the location of non-dimensional meridional distance mm−0.4 obtained by subtracting non-dimensional meridional distance 0.4 from non-dimensional meridional distance mm representing the minimum value ΔCpm are defined, and it is judged whether this value satisfies the criteria defined in the first aspect of the present invention. In the case where the variation of ΔCp is largely dependent on the variation of the shroud side, and the pressure distribution becomes such that an excessive pressure increase (or excessive deceleration of the relative velocity) occurs, a great amount of flow separation occurs at the same area generating lower head, poor efficiency or decrease in operational range. Therefore, care should be taken so as not to cause such distribution based on the CPS-$s_{,Lim}$ limit defined in the first aspect of the present invention.

Incidentally, in the case of incompressible fluid, the pressure coefficient Cp is equal to $(W/U)^2$, where W is relative velocity. In compressible fluid as in compressors, the physical variable related to the behavior of secondary flow is relative Mach number. Therefore, in the case of compressible fluid, the same judgement concerning the reduced static pressure difference ΔCp is applied to the relative Mach number difference ΔM based on the criteria defined in the first aspect of the present invention.

Further, by using the normalized pressure coefficient Cp* proposed for design criterion of secondary flow suppression as common design criterion concerning pumps and compressors, it is possible to judge from the difference between a minimum value ΔCp*m of the normalized reduced static pressure difference ΔCp* and a value $\Delta Cp^*_{m-0.4}$ of the normalized reduced static pressure difference ΔCp* at the location corresponding to non-dimensional meridional distance mm−0.4 obtained by subtracting non-dimensional meridional distance 0.4 from non-dimensional meridional distance mm representing the minimum value ΔCpm.

By the above manner, it is judged whether the optimum reduced static pressure difference can be obtained, if it is not satisfied, after going back to the second step to modify the blade loading distribution, the steps from the second step to the above steps are repeated until the optimum reduced static pressure difference is obtained. After completing this step, the blade loading distribution $\partial(r\bar{V}_\theta)/\partial m$ in which optimum reduced pressure distribution can be obtained is determined. As a result, in the design of an impeller having similar design specifications, the above mentioned optimum distribution of the blade loading $\partial(r\bar{V}_\theta)/\partial m$ is applicable, and the optimization process for the new design can be greatly accelerated.

In the fifth step (step of evaluation of flow fields), a possibility of poor performance caused by the flow separation due to rapid deceleration or rapid pressure increase in the impeller determined by the third step is evaluated. In the case where it is judged that the pressure distribution in the impeller is not appropriate, after going back to the second step to modify the blade loading distribution, the steps from the second step to the fifth step are repeated until the expected result is achieved.

In the second step of the third and fourth aspects of the present invention, the characteristics of flow fields, i.e. the blade loading distribution directly related to the flow physics, is used as input data for the third step to determine the blade profile, therefore the blade profile for suppressing the secondary flow can be promptly designed and an impeller having such blade profile can be easily manufactured, compared with the conventional manufacturing method using the modification of blade angle distribution by trial and error.

Incidentally, concerning the method in the third step to obtain the blade profile based on the specified $r\bar{V}_\theta$ distribution determined in the second step, other inverse design methods including the effects of the finite blade thickness on the velocity fields or semi-inverse methods such as Soulis, J. V., 1985, "Thin Turbomachinery Blade Design Using A Finite-Volume Method", International Journal of Numerical Methods in Engineering, vol. 21, p. 19, which are based on iterative application of analysis methods, are available, However, these methods require more computational time and are less efficient compared with that described in the third step of the third and fourth aspects of the present invention.

According to the present invention, there is provided a turbomachinery having an impeller, characterized in that the impeller is designed so that the reduced static pressure difference ΔCp or the relative Mach number difference ΔM between the hub and the shroud on the suction surface of a blade shows a remarkably decreasing tendency along the location of non-dimensional meridional distance m toward the impeller exit.

(1) In order to obtain the above remarkably decreasing tendency, the blade profile of the impeller is determined by utilizing the three-dimensional inverse design method using the blade loading distribution as input data so that the difference D between a minimum value ΔCpm of the reduced static pressure difference ΔCp and a value $\Delta Cp_{m-0.4}$ of the reduced static pressure difference ΔCp at the location corresponding to non-dimensional meridional distance mm−0.4 obtained by subtracting non-dimensional meridional distance 0.4 from non-dimensional meridional distance mm representing the above minimum value ΔCpm is selected to be a specified value which is dependent on a specific speed of the turbomachinery. Further, the difference DM between a minimum value ΔMm of the relative Mach number difference ΔM and a value $\Delta M_{m-0.4}$ of the relative Mach number difference ΔM at the location corresponding to the above non-dimensional meridional distance mm−0.4 is also selected to be a specified value which is dependent on a specific speed of the turbomachinery.

(2) Instead of the pressure coefficient Cp or the Mach number M, and thus the reduced static pressure difference ΔCp or the relative Mach number difference ΔM, the normalized pressure coefficient Cp* is commonly used for compressible fluid and incompressible fluid so that the normalized pressure coefficient difference D* corresponding to the above difference D or DM is expressed as a function of the specific speed Ns. Then, the blade profile of the impeller is determined by utilizing the three-dimensional inverse design method using the blade loading distribution as input data so that the above difference D* corresponding to the turbomachinery of a given specific speed is selected to be a specified value which complies with the above function.

(3) The turbomachinery is designed and manufactured by utilizing the three-dimensional inverse design method using the aspects characterized by the above (1) and (2) as input data.

With regard to the above-described aspects (1)–(3), whose propriety is substantiated by a large amount of verification data, therefore the present invention can be utilized effectively in industry.

According to the above aspects, since the meridional component of secondary flow can be effectively suppressed, a loss which occurs in the turbomachinery or the downstream flow channel can be reduced, emergence of a positively sloped characteristic curve can be avoided, and stability of operation can be improved. Therefore, the present invention has a great utility value in industry.

We claim:

1. A turbomachine having an impeller with a plurality of blades supported by a hub on which said blades are circumferentially spaced and covered by a shroud surface which forms an outer boundary to flow of fluid in a flow passage defining a flow direction between two adjacent blades, characterized in that:

said impeller has a configuration such that one of a reduced static pressure difference ΔCp and a relative Mach number difference ΔM between the hub and the shroud on the suction surface of the blade shows a decreasing tendency along the location of non-dimensional meridional distance m toward the impeller exit and is selected to be not less than a specified value which is dependent on a specific speed Ns of the turbomachines, herein specific speed Ns is defined as $Ns=NQ^{0.5}/H^{0.75}$, where N is the rotational speed in revolution per minutes, Q is the flow rate at an impeller inlet in cubic meter per minutes, and H is the head in meter representing fluid energy which is imparted to the fluid by the turbomachine;

said decreasing tendency of ΔCp for the turbomachine handling incompressible fluid is arranged such that the reduced static pressure difference between a minimum value ΔCpm of reduced static pressure difference ΔCp and a value $\Delta Cp_{m-0.4}$ of reduced static pressure difference ΔCp at the location corresponding to non-dimensional meridional distance $M_{m-0.4}$ obtained by subtracting non-dimensional meridional distance 0.4 from non-dimensional meridional distance $M_m$ representing said minimum value ΔCpm is selected to be not less than 0.20 at said specific speed Ns of not more than 280, not less than 0.28 at said specific speed Ns of not more than 400, and not less than 0.35 at said specific speed Ns of not more than 560; and said decreasing tendency of ΔM for the turbomachine handling compressible fluid is arranged such that relative Mach number difference between a minimum value ΔMm of the relative Mach number difference ΔM and a value $\Delta M_{m-0.4}$ of the relative Mach number difference ΔM at the location corresponding to non-dimensional meridional distance $M_{m-0.4}$ obtained by subtracting non-dimensional meridional distance 0.4 from non-dimensional meridional distance $M_m$ representing said minimum value ΔMm is selected to be not less than 0.23 at said specific speed of not more than 488.

2. The turbomachine as recited in claim 1, wherein the non-dimensional meridional distance $M_m$ representing said minimum value ΔCpm of the reduced static pressure difference ΔCp is selected to be in the range of non-dimensional meridional distance m=0.8–1.0.

3. The turbomachine as recited in claim 1 or 2, wherein a pressure coefficient slope at the shroud side CPS-s on the suction surface of the blade is selected to be not less than −1.3 as a lower limit of the pressure coefficient slope at the shroud side $CPS\text{-}s_{,Lim}$.

4. The turbomachine as recited in claim 1, wherein a Mach number slope at the shroud side Ms-s on the suction surface of the blade is selected to be not less than −0.8 as a lower limit of the Mach number slope at the shroud side $MS\text{-}s_{,Lim}$.

5. The turbomachine as recited in claim 1 or 4, wherein the non-dimensional meridional distance $M_m$ representing said minimum value ΔM of the relative Mach number difference ΔM is selected to be in the range of non-dimensional meridional distance m=0.8–1.0.

6. A turbomachine having an impeller with a plurality of blades supported by a hub on which said blades are circumferentially spaced and covered by a shroud surface which forms an outer boundary to flow of fluid in a flow passage defining a flow direction between two adjacent blades, characterized in that:

said impeller has a configuration such that normalized reduced static pressure difference $\Delta Cp^*$ between the hub and the shroud on the suction surface of a blade shows a remarkably decreasing tendency along the location of non-dimensional meridional distance m toward the impeller exit, and said remarkably decreasing tendency is arranged such that the difference D* between a minimum value $\Delta Cp^*m$ of the reduced static pressure difference $\Delta Cp^*$ and a value $\Delta Cp^*_{m-0.4}$ of the reduced static pressure difference $\Delta Cp^*$ at the location corresponding to non-dimensional meridional distance $M_{m-0.4}$ obtained by subtracting non-dimensional meridional distance 0.4 from non-dimensional meridional distance $m_m$ representing said minimum value $\Delta Cp^*_m$ is selected to be not less than $D^*=-0.004Ns+3.62$, herein specific speed Ns is defined as $Ns=NQ^{0.5}/H^{0.75}$, where N is the rotational speed in revolution per minutes, Q is the flow rate at an impeller inlet in cubic meter per minutes, and H is the head in meter representing fluid energy which is imparted to the fluid by the turbomachine.

7. A method of manufacturing a turbomachine having an impeller with a plurality of blades supported by a hub on which said blades are circumferentially spaced and covered by a shroud surface which forms an outer boundary to flow of fluid in a flow passage defining a flow direction between tow adjacent blades, comprising:

a first step of selecting meridional geometry and the number of blades of the impeller using design specification as input data, defining a plurality of surface of revolution in a meridional flow channel, and determining stacking condition $f_0$;

a second step of determining distribution of blade loading $r\overline{V}_\theta$ along non-dimensional meridional distance m by selecting a shape of the blade loading distribution $\partial(r\overline{V}_\theta)/\partial m$ which has a peak on the shroud surface in the first half of the location of non-meridional distance m and a peak on the hub surface in the latter half of the location of non-dimensional meridional distance m, adjusting a value obtained by integrating the blade loading distribution along the non-dimensional meridional distance m so as to satisfy design head of the impeller;

a third step of determining three-dimensional geometry of the impeller by integrating $$\{(\overline{V}z+V_{zb1})\partial f/\partial z\}+\{(\overline{V}r+V_{rb1})\partial f/\partial r\}=\{(r\overline{V}_{074})/r^2\}+\{(V_{\theta b1})/r\}-\omega$$

along non-dimensional meridional distance m using stacking condition $\int_0$ as initial value to determine tangential co-ordinate f of the blade camber line in non-dimensional meridional distance m and adding a certain thickness to the determined value to allow the blade to have required mechanical strength;

a fourth step of judging whether one of the distribution of reduced static pressure difference $\Delta Cp$ and the distribution of a relative Mach number difference $\Delta M$ along non-dimensional meridional distance m obtained by the third step is suitable for suppressing the secondary flow in the impeller or not;

a fifth step of evaluating possibility of poor performance caused by at least flow separation in the impeller determined by the third step, evaluating secondary flow in the impeller by a secondary flow parameter, and after going back to the second step to modify the blade loading distribution on the basis of the above evaluations, repeating the above steps until the expected result is achieved;

wherein one of a reduced static pressure difference $\Delta Cp$ and a relative Mach number difference $\Delta M$ between the hub and the shroud on the suction surface of the blade shows a remarkably decreasing tendency along the location of non-dimensional meridional distance m toward the impeller exit and is selected to be not less than a specified value which is dependent on a specific speed Ns of the turbomachines, herein specific speed Ns is defined as $Ns=NQ^{0.5}/H^{0.75}$, where N is the rotational speed in revolution per minutes, Q is the flow rate at an impeller inlet in cubic meter per minutes, and H is the head in meter representing fluid energy which is imparted to the fluid by the turbomachine;

said remarkably decreasing tendency of $\Delta Cp$ for the turbomachine handling incompressible fluid is arrange such that the reduced static pressure difference between a minimum value $\Delta Cpm$ of reduced static pressure difference $\Delta Cp$ and a value $\Delta Cp_{m-0.4}$ of reduced static pressure difference $\Delta Cp$ at the location corresponding to non-dimensional meridional distance $M_{m-0.4}$ obtained by subtracting non-dimensional meridional distance 0.4 from non-dimensional meridional distance $M_m$ representing said minimum value $\Delta Cpm$ is selected to be not less than 0.20 at said specific speed Ns of not more than 280, not less than 0.28 at said specific speed Ns of not more than 400, and not less than 0.35 at said specific speed Ns of not more than 560; and said remarkably decreasing tendency of $\Delta M$ for the turbomachine handling compressible fluid is arranged such that relative Mach number difference between a minimum value $\Delta M$ of the relative Mach number difference $\Delta M$ and a value $\Delta M_{m-0.4}$ of the relative Mach number difference $\Delta M$ at the location corresponding to non-dimensional meridional distance $M_{m-0.4}$ obtained by subtracting non-dimensional meridional distance 0.4 from non-dimensional meridional distance $M_m$ representing said minimum value $\Delta Mm$ is selected to be not less than 0.23 at said specific speed of not more than 488.

8. The method of manufacturing the turbomachine as recited in claim 7, wherein it is judged whether the non-dimensional meridional distance $M_m$ representing said minimum value $\Delta Cpm$ of the reduced static pressure difference $\Delta Cp$ is in the range of non-dimensional meridional distance m=0.8–1.0 or not.

9. The method of manufacturing the turbomachine as recited in claim 7 or 8, wherein it is judged whether pressure coefficient slope at the shroud side CPS-s on the suction surface of the blade is not less than −1.3 as a lower limit of the pressure coefficient slope at the shroud side $CPS\text{-}s_{,Lim}$.

10. The method of manufacturing the turbomachine as recited in claim 7, wherein it is judged whether the Mach number slope at the shroud side Ms-s on the suction surface of the blade is not less than −0.8 as a lower limit of the Mach number slope at the shroud side $MS\text{-}s_{,Lim}$.

11. The method of manufacturing the turbomachine as recited in claim 7 or 10, wherein it is judged whether the non-dimensional meridional distance $m_m$ representing said minimum value ΔMm of the relative Mach number difference ΔM is in the range of non-dimensional meridional distance m=0.8–1.0.

12. A method of manufacturing a turbomachine having an impeller with a plurality of blades supported by a hub on which said blades are circumferentially spaced and covered by a shroud surface which forms an outer boundary to flow of fluid in a flow passage defining a flow direction between two adjacent blades, comprising:

a first step of selecting meridional geometry and the number of blades of the impeller using design specification as input data, defining a plurality of surfaces of revolution in a meridional flow channel, and determining stacking condition $\int_0$;

a second step of determining distribution of blade loading $r\overline{V}_\theta$ along non-dimensional meridional distance m by selecting a shape of the blade loading distribution $\partial(r\overline{V}_\theta)/\partial m$ which has a peak on the shroud surface in the first half of the location of non-dimensional meridional distance m and a peak on the hub surface in the latter half of the location on non-dimensional meridional distance m, adjusting a value obtained by integrating the blade loading distribution along the non-dimensional meridional distance me so as to satisfy design head of the impeller;

a third step of determining three-dimensional geometry of the impeller by integrating $$\{(\overline{V}z+V_{zb1})\partial f/\partial z\}+\{(\overline{V}r+V_{rb1})\partial f/\partial r\}=\{(r\overline{V}_\theta)/r^2\}+\{(V_{\theta b1})/r\}-\omega$$

along non-dimensional meridional distance m using stacking condition $f_0$ as initial value to determine tangential co-ordinate f of the blade chamber line in non-dimensional meridional distance m and adding a certain thickness to the determined value to allow the blade to have required mechanical strength;

a fourth step of judging whether the distribution of normalized reduced static pressure difference ΔCp* along non-dimensional meridional distance m obtained by the third step is suitable for suppressing the secondary flow in the impeller or not; and a fifth step of evaluating possibility of poor performance caused by at least flow separation in the impeller determined by the third step, evaluating secondary flow in the impeller by a secondary flow parameter, and after going back to the second step to modify the blade loading distribution on the basis of the above evaluations, repeating the above steps until the expected result is achieved;

wherein normalized reduced static pressure difference ΔCp* between the hub and the shroud on the suction surface of a blade shows a remarkably decreasing tendency along the location of non-dimensional meridional distance m toward the impeller exit, and said remarkably decreasing tendency is judged by the fourth step whether the difference D* between a minimum value ΔCp*m of the reduced static pressure difference ΔCp* at the location corresponding to non-dimensional meridional distance $M_{m-0.4}$ obtained by subtracting non-dimensional meridional distance 0.4 from non-dimensional meridional distance $M_m$ representing said minimum value ΔCp*m is not less than D*=−0.004Ns+3.62, herein specific speed Ns is defined as $Ns=NQ^{0.5}/H^{0.75}$, where N is the rotational speed in revolution per minutes, Q is the flow rate at an impeller inlet in cubic meter per minutes, and H is the head in meter representing fluid energy which is imparted to the fluid by the turbomachine.

* * * * *